US011527227B2

(12) United States Patent
Gernhart et al.

(10) Patent No.: US 11,527,227 B2
(45) Date of Patent: Dec. 13, 2022

(54) SOUND ISOLATION ASSEMBLY

(71) Applicant: G5 Trust, Michael R. Gernhart, Trustee, Canby, OR (US)

(72) Inventors: Michael Ray Gernhart, Aurora, OR (US); Dalton Michael Jeffery Gernhart, Aurora, OR (US); Elzo Forrest Gernhart, Las Vegas, NV (US)

(73) Assignee: MTEC, LLC, Las Vegas, NV (US)

( * ) Notice: Subject to any disclaimer, the term of this patent is extended or adjusted under 35 U.S.C. 154(b) by 184 days.

(21) Appl. No.: 17/178,912

(22) Filed: Feb. 18, 2021

(65) Prior Publication Data

US 2021/0295813 A1 Sep. 23, 2021

Related U.S. Application Data

(60) Provisional application No. 62/990,917, filed on Mar. 17, 2020.

(51) Int. Cl.

| | |
|---|---|
| ***G10K 11/162*** | (2006.01) |
| ***E04F 13/08*** | (2006.01) |
| ***E04B 9/00*** | (2006.01) |
| ***E04B 1/82*** | (2006.01) |

(52) U.S. Cl.

CPC ..... *G10K 11/162* (2013.01); *E04B 1/82* (2013.01); *E04B 9/001* (2013.01); *E04F 13/0805* (2013.01)

(58) Field of Classification Search

CPC ..... G10K 11/162; E04B 9/183; E04B 9/001; E04B 2001/8254; E04B 2001/8272; E04B 2009/186; E04F 13/0805

See application file for complete search history.

(56) References Cited

U.S. PATENT DOCUMENTS

| | | | | |
|---|---|---|---|---|
| 2,115,238 A * | 4/1938 | Stevens | E04F 15/225 52/480 |
| 2,841,255 A * | 7/1958 | Kemp | E04B 9/18 52/762 |
| 6,267,347 B1 * | 7/2001 | Ryan | F16F 1/376 52/145 |
| 7,743,572 B2 * | 6/2010 | Ducharme | G10K 11/16 52/167.1 |

(Continued)

FOREIGN PATENT DOCUMENTS

| | | | |
|---|---|---|---|
| CA | 2980628 A1 * | 3/2018 | E04B 9/001 |
| CN | 112160519 A * | 1/2021 | E04B 1/86 |

(Continued)

*Primary Examiner* — Jeremy A Luks

(74) *Attorney, Agent, or Firm* — Kevin Schraven; Anooj Patel; Hankin Patent Law, APC

(57) ABSTRACT

A sound isolation assembly comprising: a center ferrule; a top grommet isolator; a bottom grommet isolator; a spring; and a furring channel engagement portion. The sound isolation assembly is configured to engage with a structure and a furring channel, which itself is connected to a ceiling panel, such that the noise passing from one floor to the other is lessened as compared to a control system that does not use the sound isolation assembly. The spring may be steel and the grommet isolators may be rubber or the like, and the combination of the steel spring and grommet isolators reduces noise.

20 Claims, 20 Drawing Sheets

(56) References Cited

U.S. PATENT DOCUMENTS

| | | | | |
|---|---|---|---|---|
| 2004/0216398 | A1* | 11/2004 | Manos | E04B 9/18 52/167.7 |
| 2008/0086966 | A1* | 4/2008 | Stevens | F16F 1/3732 52/347 |
| 2009/0283359 | A1* | 11/2009 | Ravnaas | E04B 9/001 181/286 |
| 2010/0263321 | A1* | 10/2010 | Stevens | E04B 1/84 52/741.1 |
| 2011/0140325 | A1* | 6/2011 | Downey | E04B 1/98 267/141.1 |
| 2014/0305736 | A1* | 10/2014 | Gates | E04B 1/84 181/284 |
| 2015/0233111 | A1* | 8/2015 | Gates | E04B 2/7409 181/284 |
| 2016/0297376 | A1* | 10/2016 | Chen | F16M 13/02 |
| 2020/0224413 | A1* | 7/2020 | Meisel | E04B 1/98 |

FOREIGN PATENT DOCUMENTS

| | | | | | |
|---|---|---|---|---|---|
| CN | 112160521 | A | * | 1/2021 | E04B 1/66 |
| CN | 213926995 | U | * | 8/2021 | |
| CN | 214739163 | U | * | 11/2021 | |
| GB | 2580959 | A | * | 8/2020 | E04B 9/183 |

* cited by examiner

| PAC Report Number | L3826.003 | | | | | | | |
|---|---|---|---|---|---|---|---|---|
| Testing Date | 9/21/2020 | | | | | | | |
| Floor Topping | Wood (Floating) | | | | | | | |
| Underlayment | QT4005 (Floating) | | | | | | | |
| Base Assembly | 1-1/2" Gypsum Concrete over Maxxon Acousti-Mat3/4P | | | | | | | |
| Ceiling Details | RC-Deluxe (16" o.c) - R-13 Insulation - 1 Layer USG Type C - Screws 12" o.c | | | | | | | |
| Rating | STC | | IIC | | HIIC | | LIIC | |
| Freq (Hz) | Specimen TL (dB) | Deficiencies | Normalized SPL (dB) | Deficiencies | Normalized SPL (dB) | Deficiencies | Normalized SPL (dB) | Deficiencies |
| 50 | 34.3 | - | 65.2 | - | - | - | 65.2 | - |
| 63 | 31.7 | - | 59.0 | - | - | - | 59.0 | - |
| 80 | 31.4 | - | 60.0 | - | - | - | 60.0 | - |
| 100 | 37.1 | - | 62.4 | 8 | - | - | | |
| 125 | 41.9 | 4 | 60.7 | 7 | - | - | | |
| 160 | 42.3 | 7 | 57.7 | 4 | - | - | | |
| 200 | 46.6 | 5 | 55.9 | 2 | - | - | | |
| 250 | 49.8 | 5 | 53.0 | 0 | - | - | | |
| 315 | 52.2 | 6 | 48.7 | 0 | - | - | | |
| 400 | 57.8 | 3 | 45.6 | 0 | 45.6 | 11 | | |
| 500 | 60.1 | 2 | 40.6 | 0 | 40.6 | 7 | | |
| 630 | 63.9 | 0 | 33.8 | 0 | 33.8 | 1 | | |
| 800 | 65.0 | 0 | 25.8 | 0 | 25.8 | 0 | | |
| 1000 | 66.4 | 0 | 18.7 | 0 | 18.7 | 0 | | |
| 1250 | 67.5 | 0 | 15.7 | 0 | 15.7 | 0 | | |
| 1600 | 67.0 | 0 | 12.5 | 0 | 12.5 | 0 | | |
| 2000 | 67.7 | 0 | 12.1 | 0 | 12.1 | 0 | | |
| 2500 | 68.7 | 0 | 10.0 | 0 | 10.0 | 0 | | |
| 3150 | 72.6 | 0 | 7.8 | 0 | 7.8 | 0 | | |
| 4000 | 74.6 | 0 | 7.3 | - | - | - | | |
| 5000 | 77.6 | - | 6.7 | - | - | - | | |
| 6300 | 81.0 | - | 7.4 | - | - | - | | |
| 8000 | 81.9 | - | 8.7 | - | - | - | | |
| 10000 | 76.6 | - | 9.0 | - | - | - | | |
| STC / IIC | 62 | 32 | 58 | 21 | 76 | 18 | 56 | 0 |

Fig.16

| PAC Report Number | L3826.02 | | | | | | | |
|---|---|---|---|---|---|---|---|---|
| Testing Date | 9/21/2020 | | | | | | | |
| Floor Topping | Wood (Floating) | | | | | | | |
| Underlayment | QT4005 (Floating) | | | | | | | |
| Base Assembly | 1-1/2" Gypsum Concrete over Maxxon Acousti-Mat3/4P | | | | | | | |
| Ceiling Details | RSIC-Si-X Isolators (16" o.c) - R-13 Insulation - 2 Layer USG Type C - Screws 12" o.c | | | | | | | |
| Rating | STC | | IIC | | HIIC | | LIIC | |
| Freq (Hz) | Specimen TL (dB) | Deficiencies | Normalized SPL (dB) | Deficiencies | Normalized SPL (dB) | Deficiencies | Normalized SPL (dB) | Deficiencies |
| 50 | 36.0 | - | 62.0 | - | - | - | 62.0 | - |
| 63 | 34.5 | - | 50.0 | - | - | - | 50.0 | - |
| 80 | 34.3 | - | 51.2 | - | - | - | 51.2 | - |
| 100 | 39.1 | - | 49.6 | 8 | - | - | | - |
| 125 | 45.5 | 0 | 49.9 | 8 | - | - | | - |
| 160 | 43.2 | 5 | 48.1 | 6 | - | - | | - |
| 200 | 47.1 | 4 | 47.4 | 5 | - | - | | - |
| 250 | 51.1 | 3 | 45.4 | 3 | - | - | | - |
| 315 | 53.6 | 3 | 43.9 | 2 | - | - | | - |
| 400 | 55.9 | 4 | 41.5 | 0 | 41.5 | 9 | | - |
| 500 | 57.6 | 3 | 37.5 | 0 | 37.5 | 6 | | - |
| 630 | 60.7 | 1 | 32.4 | 0 | 32.4 | 2 | | - |
| 800 | 62.3 | 1 | 25.1 | 0 | 25.1 | 0 | | - |
| 1000 | 63.4 | 1 | 18.9 | 0 | 18.9 | 0 | | - |
| 1250 | 65.6 | 0 | 15.4 | 0 | 15.4 | 0 | | - |
| 1600 | 66.4 | 0 | 11.6 | 0 | 11.6 | 0 | | - |
| 2000 | 67.4 | 0 | 11.0 | 0 | 11.0 | 0 | | - |
| 2500 | 69.0 | 0 | 8.9 | 0 | 8.9 | 0 | | - |
| 3150 | 73.0 | 0 | 7.7 | 0 | 7.7 | 0 | | - |
| 4000 | 74.6 | 0 | 7.4 | - | - | - | | - |
| 5000 | 77.7 | - | 7.1 | - | - | - | | - |
| 6300 | 81.1 | - | 7.8 | - | - | - | | - |
| 8000 | 82.5 | - | 9.2 | - | - | - | | - |
| 10000 | 79.3 | - | 9.4 | - | - | - | | - |
| STC / IIC | 61 | 25 | 70 | 32 | 79 | 18 | 65 | |

Fig.17

SOUND ISOLATION ASSEMBLY

CROSS-REFERENCE TO RELATED APPLICATIONS

This U.S. Non-Provisional Patent application claims the benefit of U.S. Provisional Patent Application No. 62/990,917, filed on Mar. 17, 2020, the contents of which are hereby expressly incorporated herein as though set forth in their entirety, and to which priority is claimed.

FIELD OF USE

The present disclosure relates generally to a device for stabilizing a fire protective membrane and providing vibration control of a suspended ceiling. More specifically, the present disclosure relates to a ceiling spring and rubber sound isolation device, sometimes referred to as a support assembly, which connects a furring channel, which is connected itself to a ceiling panel, to a building structure. The sound isolation assembly may also be used with vertical walls.

BACKGROUND

There are several sound isolation strategies for reducing indoor noise, which attempt to keep airborne sound from passing through walls and floors. One strategy is to add mass to the walls or floors by using heavy, dense materials. A second strategy is an absorptive solution by using sound absorptive material, such as fiberglass batts, in the cavities of the floors and ceilings. A third strategy is the use of sealants, that is, blocking airborne sound from leaking through gaps and cracks. Finally, and relevant to the present disclosure, is a decoupling solution. Decoupling is breaking the path of vibrations with a break in the framing or a resilient connection, frequently accomplished by a resilient channel for sound transmission reduction. A resilient channel may be installed perpendicular to the studs or joists and should have at least 3 inches of free space in the cavity behind it to be effective. A resilient channel is typically a specially-formed, metal device that, when used to hang drywall (instead of attaching the drywall directly to the wall studs or ceiling joists), significantly reduces the sound transmission of the wall or ceiling system.

The resilient channel may be secured to the studs and the drywall may then be secured to the resilient channel, which provides a break in sound transmission through the wall or ceiling.

In many building applications, furring channels are used to attach one part of a building structure, for example gypsum board or other sheet materials, to another part of the building structure. Noise transmitted structurally as vibration, is often transmitted from one part of a building to another through the furring channel connection points.

When hanging a ceiling from a structure, furring channels are typically attached to the ceiling joist, and ceiling panels are then hung from the furring channels. In order to reduce noise and vibration transferred via the connection, vibration isolation mounting methods have been employed. For example, mounting clips for mounting standard furring channels to ceiling joist surfaces such that ceiling panels secured to the furring channels are vibrationally isolated from the ceiling joist surfaces. The older style clips can be expensive to manufacture and, in some cases, only provide minimal vibration isolation.

Light gauge steel channels (commonly referred to as resilient channels) formed into lazy Z-shapes have been the dominate noise control isolation product in the construction industry since the mid 1960's. In the early 2000's, the first rubber dampened isolators were introduced to the marketplace. The trouble with the rubber isolator is that it has frequency limitations. Rubber is not exceptional at managing or controlling low frequency vibration. Rubber is very useful in controlling mid-range and high-range frequencies. Prior to the sound isolation assembly of the present disclosure, rubber was not combined with any other device to manage low frequency noises.

To provide a better solution to a long-standing traditional problem, what is needed is a solution which uses both a compact high-performance wave style steel spring, for the control of low frequency vibration and rubber (natural or synthetic) to control mid-range and high end vibrations.

SUMMARY

To minimize the limitations in the cited references, and to minimize other limitations that will become apparent upon reading and understanding the present specification, the present specification discloses a spring and rubber sound isolation assembly.

The sound isolation assembly may also relate to fire, life, and safety in the form of stabilization of the fire protective membrane during a fire event and vibration/sound control and in particular to a ceiling spring and rubber isolation hanger and a floating ceiling construction using the same.

In one embodiment the spring and rubber sound isolation assembly of the present disclosure may comprise a center ferrule, a top grommet isolator (which is typically made from a natural or synthetic rubber), a snap on retainer clip, a metal claw that is configured to retain a drywall furring channel (DFC) (aka Furring Channel), a bottom grommet (which is typically made from a natural or synthetic rubber), and a low profile multi-wave crest to crest steel compression spring with shim ends. The center ferrule may have a center brushing that keeps the spring centered.

In various embodiments, the spring may be one of several different types of springs, including but not limited to, compression, multi-wave, conical, conical tapered (both outward and inward), cylindrical, barrel, double barrel, hourglass, convex, concave, straight coil, volute, and the like.

The sound isolation assembly device of the present disclosure compares favorably to systems that do not include the device. Applicant's studies show a marked increase in noise control over just using a furring channel with normal connectors.

One embodiment of the device of the present disclosure may be a sound isolation assembly comprising: a center ferrule; a top grommet isolator; a bottom grommet isolator; a spring; and a furring channel engagement portion; wherein the center ferrule comprises a shaft and a center ferrule base; wherein the bottom grommet isolator comprises a bottom grommet base; wherein the top grommet isolator comprises a top grommet base; wherein the furring channel engagement portion comprises a hole and is configured to engage with a furring channel; wherein the top grommet base is configured to engage with both a top portion of the spring and an underside of the furring channel engagement portion, such that the spring is substantially prevented from contacting the furring channel engagement portion; wherein the bottom grommet base is configured to engage with both the center ferrule base and a bottom portion of the spring, such that the spring is substantially prevented from contacting the center ferrule; wherein the center ferrule base and the spring each have a diameter that is greater than the diameter of the hole of the furring channel engagement portion; and wherein the center ferrule is configured to be connected to be attached to a structure. The sound isolation assembly may further comprise a snap retainer clip; wherein the center ferrule comprises a snap retainer clip groove at a top portion of the shaft of the center ferrule; and wherein the snap retainer clip is configured to matingly engage with the snap retainer clip groove, such that, when the sound isolation assembly is assembled and the snap retainer clip is snapped into the snap retainer clip groove, the top grommet isolator, the furring channel engagement portion, the spring, and the bottom grommet isolator are substantially held below the snap retainer clip. The spring may be a steel spring. The spring may be a multi-wave crest to crest compact steel spring with shim ends. In various embodiments, the spring is selected from the group of springs consisting of: compression; multi-wave; conical; tapered; cylindrical; barrel; double barrel; hourglass; convex; concave; straight coil; and volute. The sound isolation assembly may sometimes include a center brushing that is configured to be between the shaft and the spring, and that is configured to keep the spring from becoming misaligned. The top grommet isolator may be rubber or the like and may comprise a centering cone that is configured to keep the spring from becoming misaligned. The bottom grommet isolator may be rubber or the like and may comprise a centering cone that is configured to keep the spring from becoming misaligned. The assembly may be connected to a structure, wherein the structure is selected from the group of structures consisting of: a joist; a wood I-joist; a truss; a steel C section; a concrete slab; a steel pan deck; and a multi-clip. When the sound isolation assembly is connected to a structure, and when the furring channel engagement portion is connected to the furring channel, and when the furring channel is connected to a ceiling panel, noise passing through the ceiling panel is substantially dampened relative to a control system that does not use the sound isolation assembly. The snap retainer clip may be metal and may be substantially ring shaped. The top grommet isolator may be substantially ring shaped. The bottom grommet isolator may be substantially ring shaped.

The ceiling spring and rubber sound isolation assembly may be a compact steel spring and rubber isolator that may be engineered to provide the low frequency noise control advantages of a coil compression spring and the mid and high frequency noise control advantages of a rubber isolator.

The carbon footprint of heavy gauge steel support brackets and large cylindrical coil steel springs of designs prior to the assembly of the present disclosure are more than ten (10) times the carbon footprint of the sound isolation assembly due to the assembly's streamline design, which is a huge reduction of the steel components need to support the spring.

The sound isolation assembly of the present disclosure offers a huge freight savings over the traditional cylindrical coil compression steel spring assembly because of the lower weight. The sound isolation assembly weight is two point one (2.1) ounces compared to the traditional cylindrical coil compression steel spring assembly weight at thirty-two (32) ounces. The net difference is that the assembly has less than one-sixteenth (1/16) the shipping weight and uses less than one sixteenth (1/16) the cubic shipping space.

Distribution networks and job site materials handling is reduced by more than ninety (90%) percent due the compact size and weight of the assembly of the present disclosure. The sound isolation assembly is preferably 100% recyclable. Manufacturing the sound isolation assembly is substantially easier than traditional cylindrical coil compression steel spring assembly whereas there are fewer components and less weight to work with during the assembly process.

The sound isolation assembly of the present disclosure may be part of a system that ensures a uniformly level ceiling after the complete acoustical design load (dead load) has been installed on the multiple sound isolation assemblies.

The steel spring and rubber grommet isolators of the sound isolation assembly complement each other to provide a broad spectrum of noise and vibration control from 5 hertz through 10,000 hertz.

Other features and advantages will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

FIG. 16 is a testing table showing the acoustic tests results of a best in class furring channel without the sound isolation assembly, showing Sound Transmission Class (STC) (decibels at selected frequencies), Impact Isolation Class (IIC) using ASTM E-492 (normalized decibels at selected frequencies), High Impact Isolation Class (HIIC) using ASTM E-3222 (normalized decibels at selected frequencies), and Low Impact Isolation Class (LIIC) using ASTM E-3222 (normalized decibels at selected frequencies).

FIG. 17 is a testing table showing the acoustic tests results of the furring channel used in connection with a sound isolation assembly of the present disclosure, showing Sound Transmission Class (STC) (decibels at selected frequencies), Impact Isolation Class (IIC) using ASTM E-492 (normalized decibels at selected frequencies), High Impact Isolation Class (HIIC) using ASTM E-3222 (normalized decibels at selected frequencies), and Low Impact Isolation Class (LIIC) using ASTM E-3222 (normalized decibels at selected frequencies).

DESCRIPTION OF THE DRAWINGS

Figure 1:
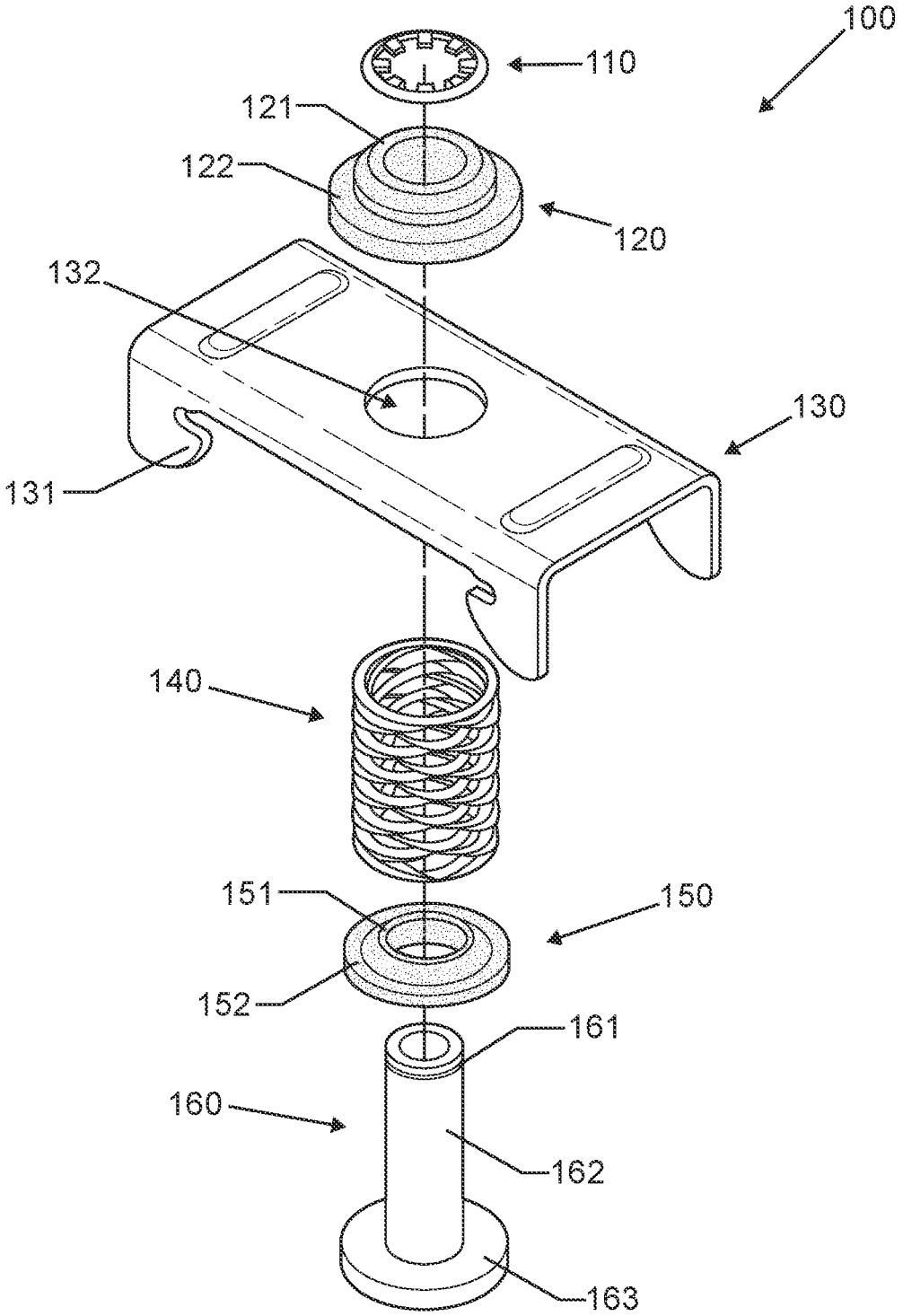
FIG. 1 is an illustration of an exploded view of one embodiment of the sound isolation assembly.

In the following detailed description of various embodiments, numerous specific details are set forth in order to provide a thorough understanding of various aspects of the embodiments. However, the embodiments may be practiced without some or all of these specific details. In other instances, well-known procedures and/or components have not been described in detail so as not to unnecessarily obscure aspects of the embodiments.

While some embodiments are disclosed here, other embodiments will become obvious to those skilled in the art as a result of the following detailed description. These embodiments are capable of modifications of various obvious aspects, all without departing from the spirit and scope of protection. The Figures, and their detailed descriptions, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, group of items, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, group of items, or result. In another example, substantially all of a group of items, may include all of the items of that group, or at least all of the items of that group that re generally within the normal parameters for the items. To the extent that the group of items might include members that far exceed the normal parameters, this abnormal item might not be expected to be part of substantially all the group of items.

As used herein, the terms "approximately" and "about" generally refer to a deviance of within 5% of the indicated number or range of numbers. In one embodiment, the term "approximately" and "about", may refer to a deviance of between 0.0001-10% from the indicated number or range of numbers.

The drawings show illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

FIG. 1 is an illustration of an exploded view of one embodiment of the ceiling spring and rubber sound isolation assembly. The ceiling spring and rubber sound isolation assembly 100 may comprise a center ferrule 160, which may have a snap retainer clip groove 161, a shaft 162, and a base 163, a top grommet isolator 120, which may be rubber and may comprise a base 122 and a centering cone 124 (shown in FIG. 4), a snap retainer clip 110, a metal claw portion 130 that is configured to retain a drywall furring channel (DFC), a bottom grommet isolator 150, which may comprise a base 152, a centering cone 151, and a spring 140, which may be a low profile multi-wave crest to crest steel compression with shim ends. In some embodiments, the furring channel may be seven eights (⅞") inch (22 mm) deep by two and three quarters (2¾") inch (69 mm) wide by twenty-five (25 ga.) gauge steel with hemmed edge details. As shown, the snap retainer clip 110 may be a ring, but it also may be a clip or spring, so long as it snaps into the groove 161 and is substantially prevented from being inadvertently or easily dislodged. The snap retainer clip may be any device (clip, nut, ring, cap, and the like) that substantially prevents the top grommet isolator 120, and all the parts and portions under the top grommet isolator 120 from sliding off of the center ferrule 160.

The claw portion 130 is preferably made from steel or another strong metal. The claw portion 130 is called a claw portion because it resembles a claw and has four hooks 131 that are configured to engage a furring channel, which typically has two side flanges. The claw portion 130 can be any furring channel engagement device or furring channel engagement portion, so long as it is configured to engage with some type of furring channel or equivalent device.

In one embodiment, due to the compact size provided by a wave crest to crest steel compression spring, which is preferred, the ceiling spring and rubber sound isolation assembly 100 may be installed directly to the bottom of the structural members with minimal loss of over head space. The ceiling spring and rubber sound isolation assembly 100 may be configured to have one (1) full inch (25 mm) of free height. The ceiling spring and rubber sound isolation assembly 100 may deflect a total of one half (½") inch (12 mm) when the full Acoustical Design Load (dead load) is applied during installation. Preferably, the one half (½") inch (12 mm) of deflection in a multi-wave crest to crest compact compression spring 140 performs acoustically similar to a conventional cylindrical compression spring with four (4) inch (100 mm) free height and one (1) full inch (25 mm) of deflection with the full load of the Acoustical Design Load (dead load) applied. The ceiling spring and rubber sound isolation assembly 100 may have a low profile (compact) design that provides a method of installation that can be directly applied to the bottom of a structural framing member.

The ceiling spring and rubber sound isolation assembly 100 may preferably be easy to install and may allow a user to achieve a level full floating spring hung gypsum board ceiling. The spring 140 may come in various base strengths, such as: twenty six (26) pounds; thirteen (13) pounds; and seven (7) pounds.

Other embodiments may use different spring strengths such as 36 pounds, 18 pounds, and 9 pounds, which will provide for different spacing on the furring channels while supporting two or three layers of gypsum board at weights up to 2.5 pounds per square foot per layer.

Typically, a single layer of Type C gypsum board (or equivalent drywall) has a weight of two and half (2.5) pounds per square foot. To achieve greater noise control, the typical noise control ceiling installation will require two (2) layers of gypsum board, which is five (5) pounds per square foot. Assuming the drywall furring channels are installed at sixteen (16) inch on center, the sound isolation assembly 100 may preferably be installed at forty eight (48) inch on center (1.33'×4'=5.33 sq ft/isolator×5#/sq ft=26.66#/device in the field).

Assuming a typical room is twelve (12) foot square, there should be four (4) sound isolation assemblies 100, one in each corner. Additionally, there may be two (2) sound isolation assemblies 100 on each side plus five (5) additional sound isolation assemblies 100 on each end of the room. Finally, there may be ten (10) sound isolation assemblies 100 spaced uniformly in the center of the room. A total of twenty-eight (28) sound isolation assemblies 100 may be used to support one hundred forty-four (144) square foot double gypsum ceiling coverage (five point one four (5.14) square foot per sound isolation assembly 100). The coverage per sound isolation assembly 100 may vary depending upon the actual size of the room in which it is used. Acoustical Design Load may also vary by changing the spacing of the furring channels and/or changing the spacing of the sound isolation assembly 100 while maintaining the deflection in the spring 140.

Typically, the sound isolation assembly 100 may be screwed to the bottom of the floor-ceiling or roof-ceiling timber structural member, such as a solid timber joist, open web truss, or I beam joist. In some embodiments, the screw may be a number seven (#7) or number eight (#8) shank screw that may be two and three quarter (2.75) inch (70 mm) to three (3) inch (75 mm) long, bugle head screw with type seventeen (17) tip, course or fine thread, rust resistant coating and Phillips #2drive. Alternative fasteners can also be used to secure the sound isolation assembly 100 to the structural members.

The installed snap retainer clip 110 may provide both preload and may hold the entire sound isolation assembly 100 together as one unit prior to installation. The center ferrule 160 may provide the precision depth stop to make the pre-load exactly fifty percent (50%) of the Acoustical Design Load, which thus makes the gypsum board installation (dead load) easier for the installers to account for any deflection. In order to have a certified fire resistive design, the assembly, during a full scale fire test, must keep the gypsum board in a level plane. To accomplish this, the sound isolation assembly 100 may be configured to provide minimal added deflection or deviation as the grommets become involved (burn) during the fire. Preferably, the base 163 of the center ferrule 160 has a diameter greater than that of the diameter of the spring 140 and hole 132 of the claw portion 130, which acts as a failsafe steel to steel connection even after the fire test is complete. In other words, if the grommet isolators 120 and 150 burn away, the base 163 of the center ferrule 160, which is preferably steel, does not slip through the spring 140 and/or hole 132 of the claw portion 130, which would cause the gypsum board ceiling to fall.

The ceiling spring and rubber sound isolation assembly 100 mounting screw may be a #7shank, type 17 tip, 2-¾ (70 mm)~3" (75 mm) long, course thread, bugle head, Phillips #2 drive, rust inhibiting coating the screw that may be engineered with a slim shank to reduce the trauma to the structural framing member. The type 17 tip may tear the timber fibers as the screw tip pulls itself through the structural member thus providing less resistance/drag on the shank to avoid spiral fracturing of the shank. The length is to ensure one and one half (1½") (37 mm) inch minimum penetration in case of fire. The bugle head is to provide stability to the center ferrule 160. #2 Phillips drive is the most commonly use drive in the gypsum board installation business. Alternative fasteners may also be used if they provide the strength and penetration in the case of earthquake or fire.

A preferred component of the sound isolation assembly 100 may be a multi-wave crest to crest compact steel spring with shim ends 140. This spring 140 may be smaller and more compact than other steel springs with one (1") inch free height and one half (½") inch (12 mm) deflection. The substantial reduction in physical size and the relatively large deflection provided makes this spring close to optimal for controlling most of the most offensive low frequency noises, specifically noise below 500 hertz.

As shown in FIG. 1, the top grommet isolator 120 is designed to (1) isolate the claw portion 130 (which is preferably made of steel or another strong metal) from the center ferrule 160 (which is preferably made from steel or another strong metal), and (2) isolate the multi-wave crest to crest compact steel spring with shim ends 140 from the center steel ferrule 160 and the claw portion 130. The top grommet isolator 120 may have outward projection flanges on base 122, an upper portion 121, and a cone shaped centering portion 124 (shown in FIG. 4) to cause the spring 140 to self-center on the top grommet isolator 120. The durometer of the top grommet isolator 120 may be configured to help control or dampen frequencies above 500 hertz, which are not dampened by the spring 140. As shown, the top grommet isolator 120 is shaped and configured so that it may matingly engage with hole 132, such that the upper portion 121 is above the hole 132 and base 122 is below the hole 132 and the shaft 162 is prevented from touching the sides of the hole 132.

As shown in FIG. 1, the bottom grommet isolator 150 (which may preferably be made from rubber) may have an outward projecting flange or base 152 to isolate the spring 140 from the base 163 of the center ferrule 160. The bottom grommet isolator 150 may be configured to have a center cone 151, which may cause the spring 140 to self-center and provide uniform clearance between the center ferrule 160 and the spring 140. The durometer of the bottom grommet isolator 150 may be configured to help control or dampen frequencies above 500 hertz.

Center ferrule 160 may have a snap retainer clip groove 161 cut into the top end of the center ferrule 160 so the snap retainer clip 110 can hold all the components in preload compression thereby keeping all the components in place and in alignment and provide at least a uniform fifty percent (50%) preload compression. In one embodiment, the center ferrule 160 provides a central guide that may manage the lateral movement of the claw portion 130 in the event that a seismic event occurs. Additionally, the center ferrule 160 of the sound isolation assembly 100 may act as a Fail-Safe Stop during a fire event because the diameter of the base 163 of the center ferrule 160 is preferably larger than the diameter of center hole 132 of the claw portion 130. Even if the grommet isolators 120, 150 melt or are burned away (as they might because they are preferably made of a natural or synthetic rubber or plastic material) the sound isolation assembly 100 still holds together due to the configuration of its metal or steel components.

The claw portion 130 may preferably be configured to be a friction fitted connection between the sound isolation assembly 100 and a traditional furring channel and, in some embodiments, may be seven eights (⅞") inch deep by two and three quarter (2¾") inch wide by twenty five (25 ga.) gauge with hemmed edge details. The claw portion 130 may be configured to provide greater than five hundred (500%) percent margin of safety between the Acoustical Design Load and the ultimate failure of the assembly.

The snap retainer clip 110 may be configured to be easily installed (snapped into place into groove 161) and not be easily or inadvertently removed during manufacturing, storage, shipping, distribution, and job site installation of the sound isolation assembly 100. The snap retainer clip 110 may provide component alignment and preload on the spring 140 to minimize the issues caused by high deflection during installation. The snap retainer clip 110 may preferably provide fifty (50%) percent of the total deflection provided by spring 140 as preload.

In some embodiments, the center ferrule 160 may change from being 1⅜" long to 2⅜" long, which is a one (1) inch increase in the overall length. The claw portion 130 depth may change from ⅜" to 1⅜". Retaining the same industry standard furring channel seven eights (⅞") (37 mm) inch deep by twenty-five (25ga.) gauge with hemmed edge detail. Other embodiments may use an alternative drywall furring channel that is 1½" (37 mm) deep by twenty-five (25 ga.) gauge with hemmed edge detail, which allows for greater depth and/or greater span capacity. An alternative furring channel used may be 1½" (37 mm) deep×twenty-five (25 ga.) gauge. The spring 140 may preferably change from one (1) inch free height with one half (½) inch deflection at the Acoustical Design Load to two (2) inch free height with one (1) inch of deflection at the Acoustical Design Load. Further, with a longer center ferrule 160, the fastener may need to be one (1) inch longer from two and three quarter (2¾") inch to three and three quarter (3¾").

Although specific measurements are provided, any measurements may be used.

The sound isolation assembly 100 is preferably configured to stop the transfer of vibration (noise) from floor to floor (or from room to room). Specifically, the sound isolation assembly 100 may preferably comprise a multi-wave crest to crest steel compression spring 140 with one (1") inch of free height and one half (½") inch of deflection when loaded at a prescribed Acoustical Design Load. The incorporation of this embodiment of the spring 140 provides control of vibration (noise) at lower frequencies than can be managed when only incorporating rubber isolators. More specifically, at a frequency of 500 hertz and below, the rubber isolators are overpowered by the larger and stronger sound pressure waves that are associated with low frequency sounds. The ceiling spring and rubber sound isolation assembly 100 is configured to be the lowest profile compact sound isolator ever created and it has an improved energy management available in the multi-wave crest to crest steel compression spring with shim ends that may be used as spring 140.

In various embodiments, the sound isolation assembly 100 may comprise two rubber grommet isolators 120, 150, which may efficiently dampen frequencies above 500 hertz better than only using a metal or steel spring 140.

The sound isolation assembly 100 may be installed directly to the bottom of a floor/ceiling structural member (i.e., joist or truss). The traditional cylindrical coil compression steel spring assembly is side mounted to the structural member (joist or truss) which may require blocking where a solid backing is not in the exact spacing required by the traditional spring isolators. Proper blocking to support the traditional spring isolators is labor intensive, which means it is more expensive.

The sound isolation assembly 100 preferably requires less vertical space to install on the bottom of the structural members than the traditional cylindrical coil steel spring isolator installed to the sides of the structural members.

The snap retainer clip 110 may provide a preload or precompression of spring 140 thereby reducing the amount of deflection that the installing crew must compensate for and it provides greater stability to the ceiling support members. Additionally, the snap retainer clip 110 may function to hold all of the components in place during warehousing and shipping prior to installation.

The claw portion 130 may connect to the furring channel while being suspended by the spring 140. The claw portion 130 may preferably be configured to be made of steel and may provide greater than eight times the safety margin between Acoustical Design Load and Ultimate Load in both pull and shear.

The spring 140, in one embodiment, may be a multi-wave crest to crest steel compression spring that may be made from round wire stock and cold processed to provide the full one-inch (25 mm) free height and one half inch (12 mm) deflection at the specified Acoustical Design Load needed for the ceiling spring and rubber sound isolation assembly with the smallest carbon foot print possible for a spring.

The center ferrule 160 may preferably be ⅜" (10 mm) OD×¼" (6 mm) ID×1⅜" (35 mm) long with a retainer ring retailer groove 161 cut in the top (small) end and a ⅞" (22 mm) flanged base 163 on the bottom (opposite) end.

When the assembly 100 is in use, vibration (noise) energy is forced to travel through the center ferrule 160, the above 500 hertz sound pressure waves or vibration is controlled by the two (2) grommet isolators 120, 150, which are preferably made of rubber or some other similar type of visco-elastic dampening material or compound, such as, but not limited to, neoprene, ethylene-propylene-diene, nitriles, silicone, polysiloxane, styrene-butadiene, butyl, hapalon, urethane, hexafluoropropylene-vinylidene fluoride, fluoro-silicone, and the like. The low frequency below 500 hertz energy or vibration is substantially blocked or dampened by the spring 140. Noise that is not controlled by the spring 140 or the grommet isolators 120, 150, may be controlled by the point of connection between the claw portion 130 and the furring channel. Additionally, just as the assembly 100, when connected to the ceiling panels and furring channels provides superior noise transmission, superior heat transmission is also accomplished, which makes the assembly 100 an excellent fire-resistant design.

The center ferrule 160 may act as a center guide-post that may keep the top grommet isolator 120 and claw portion 130 in alignment, while also acting in a vertical reaction to the vibrations from impact on the floor above. The center ferrule 160 may provide a stable base 163 to support the entire Acoustical Design Load imposed by the ceiling load transferred through the furring channels to the claw portion 130, then to the spring 140, and finally to the bottom grommet isolator 150, which is resting on the base 163 of the center ferrule 160. The center ferrule 160 allows the top grommet isolator 120 and the claw portion 130 to freely float without a chance of turn over from lateral forces.

The top grommet isolator 120 is configured to matingly and fittingly engage with hole 132 of the claw portion 130, such that the claw portion is substantially prevented from contacting the shaft 162 of the center ferrule 160.

Figure 2:
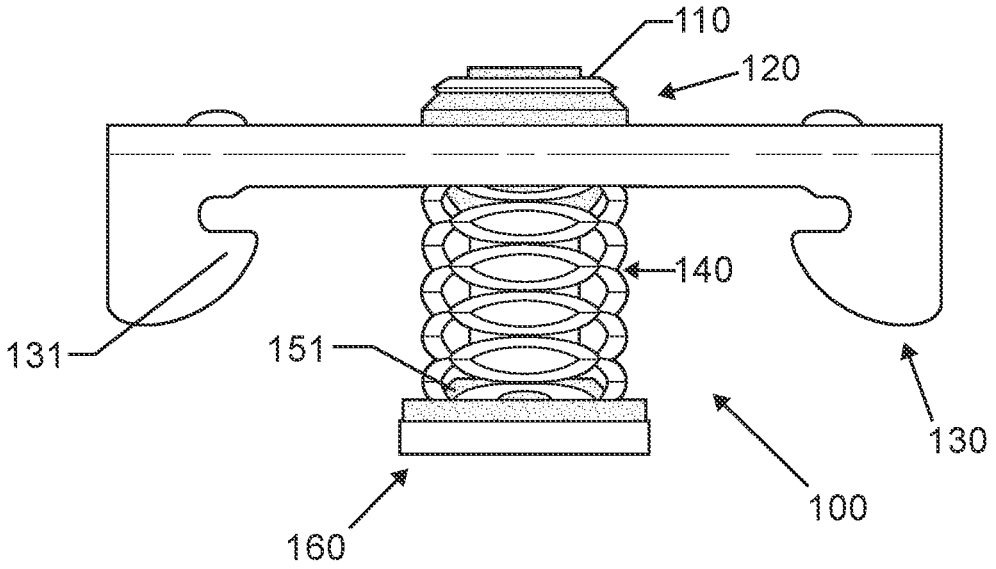
FIG. 2 is an illustration of a side view of one embodiment of the sound isolation assembly, showing the assembly in a resting position.

FIG. 2 is an illustration of a side view of one embodiment of the sound isolation assembly, showing the assembly in a resting position. As shown in FIG. 2, the sound isolation assembly 100 may comprise a center ferrule 160, a top grommet isolator 120, a snap retainer clip 110, a metal claw portion 130 that is configured to retain a drywall furring channel (DFC) at hooks 131, a bottom grommet isolator 150, which may have a centering cone 151, and a spring 140. FIG. 2 shows that the centering cone 151 may align spring 140 so that it does not shift laterally.

Figure 3:
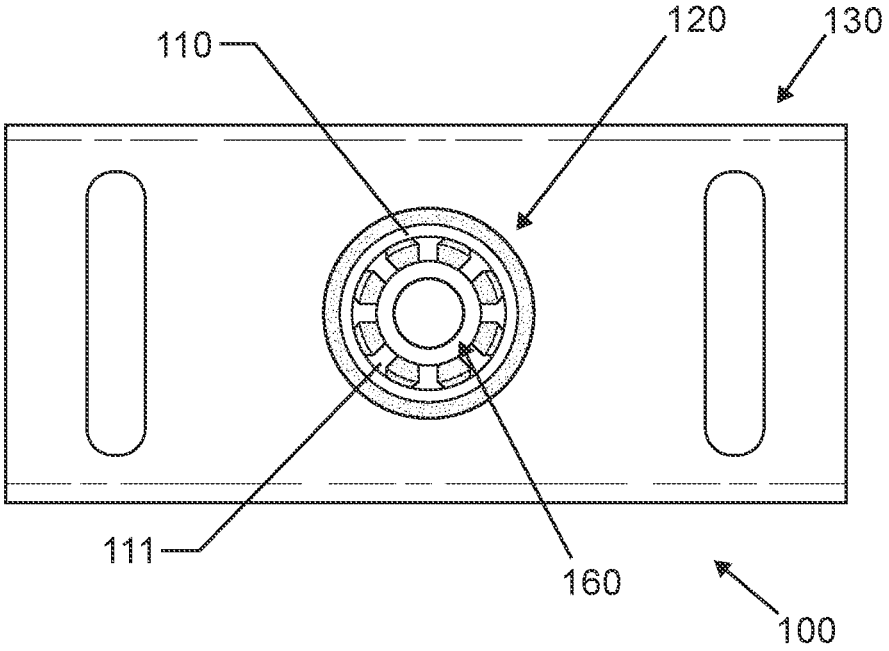
FIG. 3 is an illustration of a top view of one embodiment of the sound isolation assembly.

FIG. 3 is an illustration of a top view of one embodiment of the sound isolation assembly. As shown in FIG. 3, the sound isolation assembly 100 may comprise a center ferrule 160, a top grommet isolator 120, a snap retainer clip 110, a metal claw portion 130. FIG. 3 shows that the clip 110 may be a ring with partial spokes 111 that are configured to engage with the groove 161 of the center ferrule 160.

Figure 4:
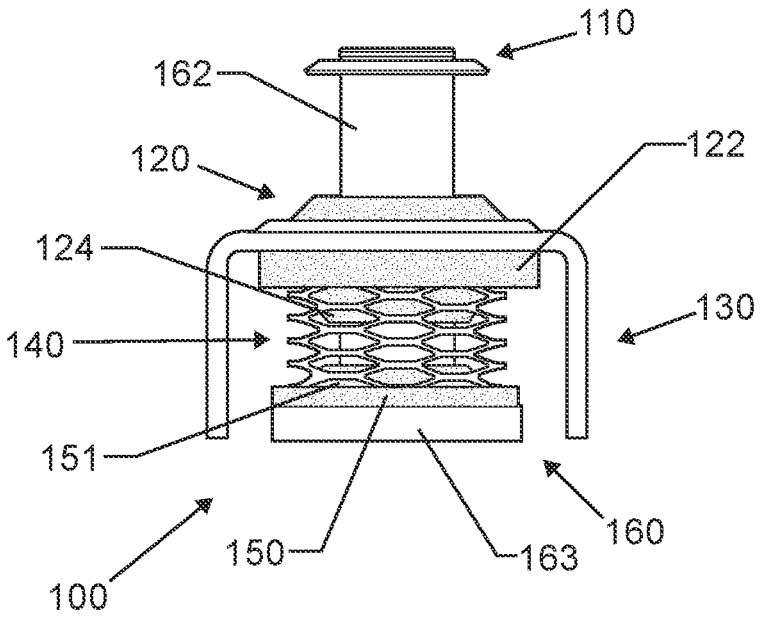
FIG. 4 is an illustration of a front view of one embodiment of the sound isolation assembly, showing the assembly in a compressed position.

FIG. 4 is an illustration of a front view of one embodiment of the sound isolation assembly, showing the assembly in a compressed position. As shown in FIG. 4, the sound isolation assembly 100 may comprise a center ferrule 160, with main shaft 162 and base 163, a top grommet isolator 120, which may comprise a base 122 and a centering cone 124, a snap retainer clip 110, a metal claw portion 130, a bottom grommet isolator 150, which may have a centering cone 151 and base 152, and a spring 140. FIG. 4 shows that the centering cones 124, 151 may align spring 140 so that it does not shift laterally. The grommet isolators 120, 150 themselves are held in place and aligned by the main shaft 162. FIG. 4 shows how the spring 140 is isolated between base 122 and base 152, such that the spring 140 works in conjunction with the isolators 120, 150 to substantially reduce both low frequency and mid/high frequency noises from passing from floor to floor or from room to room.

Figure 5:
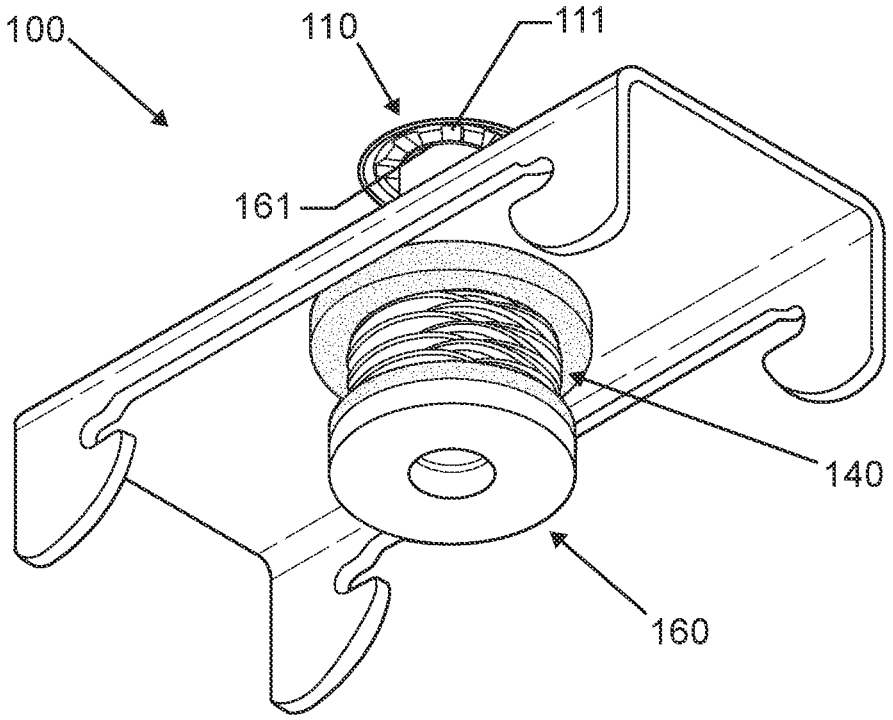
FIG. 5 is an illustration a bottom perspective view of one embodiment of the sound isolation assembly.

FIG. 5 is an illustration a bottom perspective view of one embodiment of the sound isolation assembly. FIG. 5 shows the spring 140 in a compressed configuration and shows how the partial spokes 111 of the snap retainer clip 110 tension snap into the groove 161 of center ferrule 160. Once snapped into place, the snap retainer clip 110 may be forcibly removed or broken, but such removal is configured to be very difficult and the tension and strength of the partial spokes 111 should be such that the load on the assembly 100 may be entirely born by the snap retainer clip 110 without failing or being dislodged from the groove 161.

Figure 6:
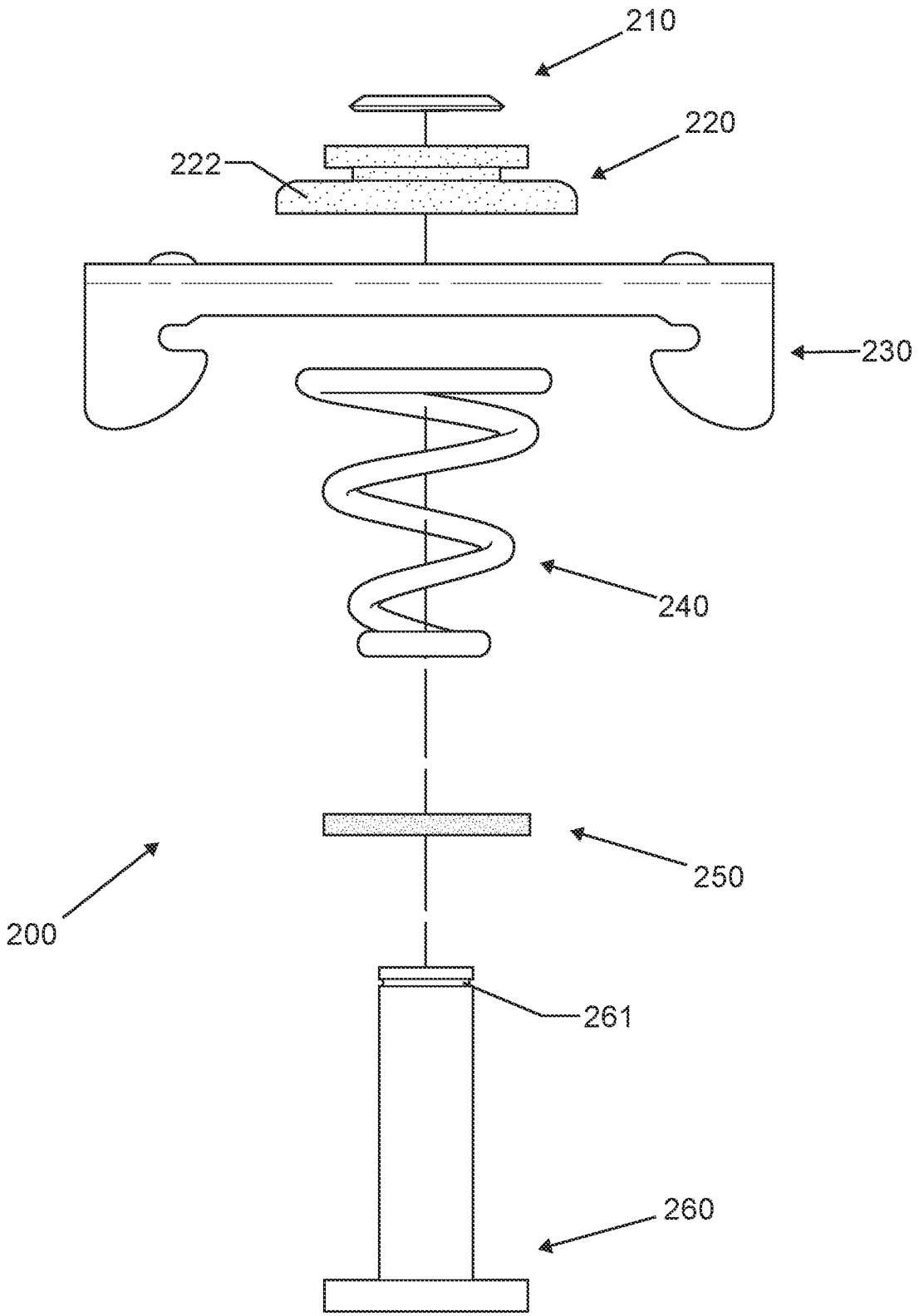
FIG. 6 is an illustration of an exploded view of another embodiment of the sound isolation assembly.

FIG. 6 is an illustration of an exploded view of another embodiment of the sound isolation assembly. As shown in FIG. 6, another embodiment of the sound isolation assembly 200 may comprise a center ferrule 260, which may have a snap retainer clip groove 261, a top grommet isolator 220, which may comprise a base 222, a snap retainer clip 210, a metal claw portion 230 that is configured to retain a drywall furring channel, a bottom grommet isolator 250, and a spring 240. The spring 240 may have a conical configuration, which provides a strong triangular configuration and eliminates the need to have center cones on the grommets 220, 250. Because the spring 240 has a narrow end, it is substantially kept in place without having to worry about misalignment. The sound isolation assembly 200 shown in FIG. 6 is even lighter than the assembly 100 shown in FIG. 1, because the spring 240 and grommet isolators 220, 250, have less mass than their counterparts shown in FIG. 1.

Figure 7:
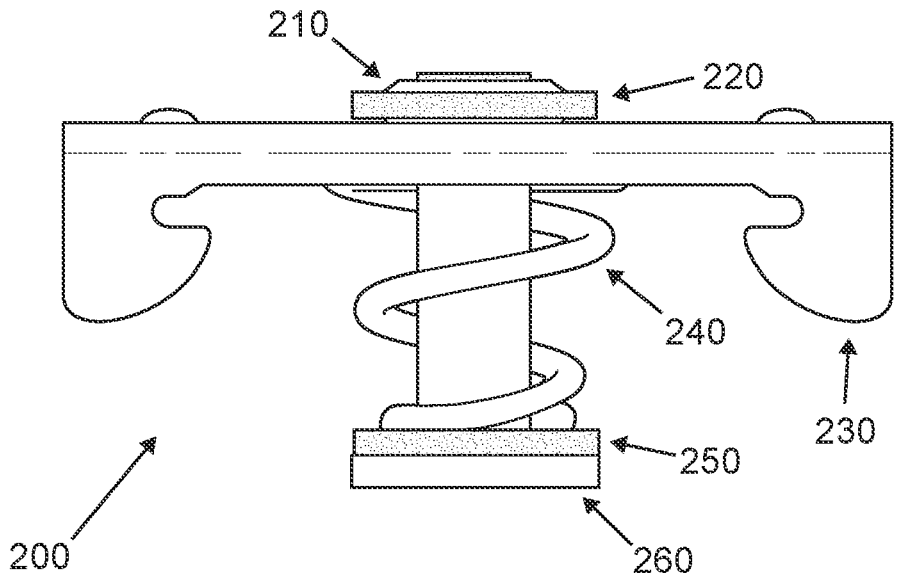
FIG. 7 is an illustration of a side view of another embodiment of the sound isolation assembly, showing the assembly in a resting position.

FIG. 7 is an illustration of a side view of another embodiment of the sound isolation assembly, showing the assembly in a resting position. As shown in FIG. 7, the sound isolation assembly 200 may comprise a center ferrule 260, a top grommet isolator 220, a snap retainer clip 210, a metal claw portion 230, a bottom grommet isolator 250, and a spring 240. Spring 140 and spring 240 are just two of the many shapes and types of springs that may be used in the sound isolation assembly of the present disclosure to dampen and/or substantially prevent noise from traveling from floor to floor or room to room.

Figure 8:
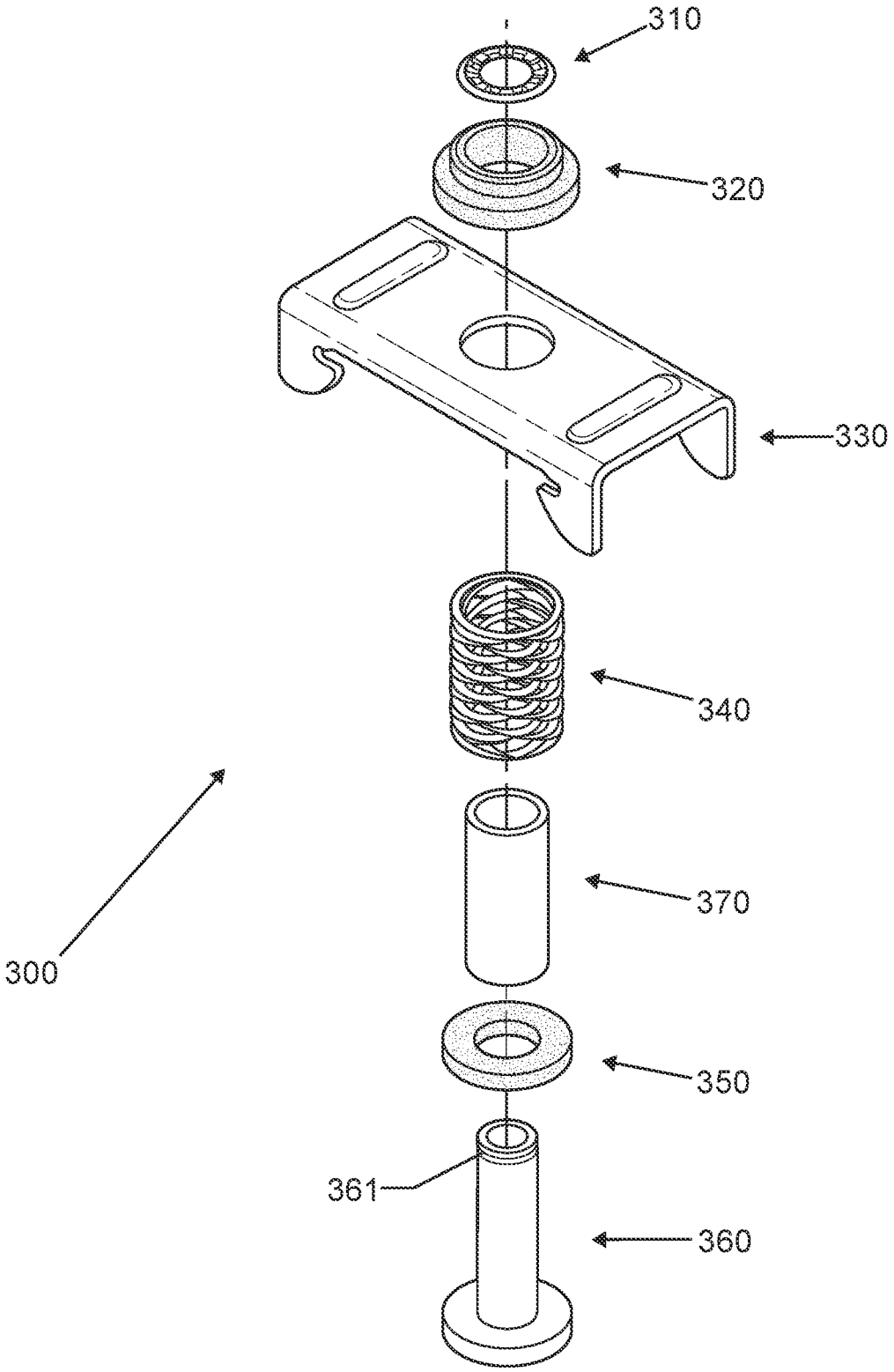
FIG. 8 is an illustration of an exploded view of a third embodiment of the sound isolation assembly and shows a center brushing.

FIG. 8 is an illustration of an exploded view of a third embodiment of the sound isolation assembly and shows a center brushing. As shown in FIG. 8, another embodiment of the sound isolation assembly 300 may comprise a center ferrule 360, which may have a snap retainer clip groove 361, a top grommet isolator 320, a snap retainer clip 310, a metal claw portion 330 that is configured to retain a drywall furring channel, a bottom grommet isolator 350, center brushing 370, and a spring 340. The center brushing 370, in addition to providing additional sound dampening properties, may keep the spring 340 aligned around the center ferrule 360. Preferably, the center brushing 370 is made from a slick/non-stick material, such as nylon, fluoropolymers, amide polymers, and the like. This allows for a seamless compression and release of the spring 340.

Figure 9:
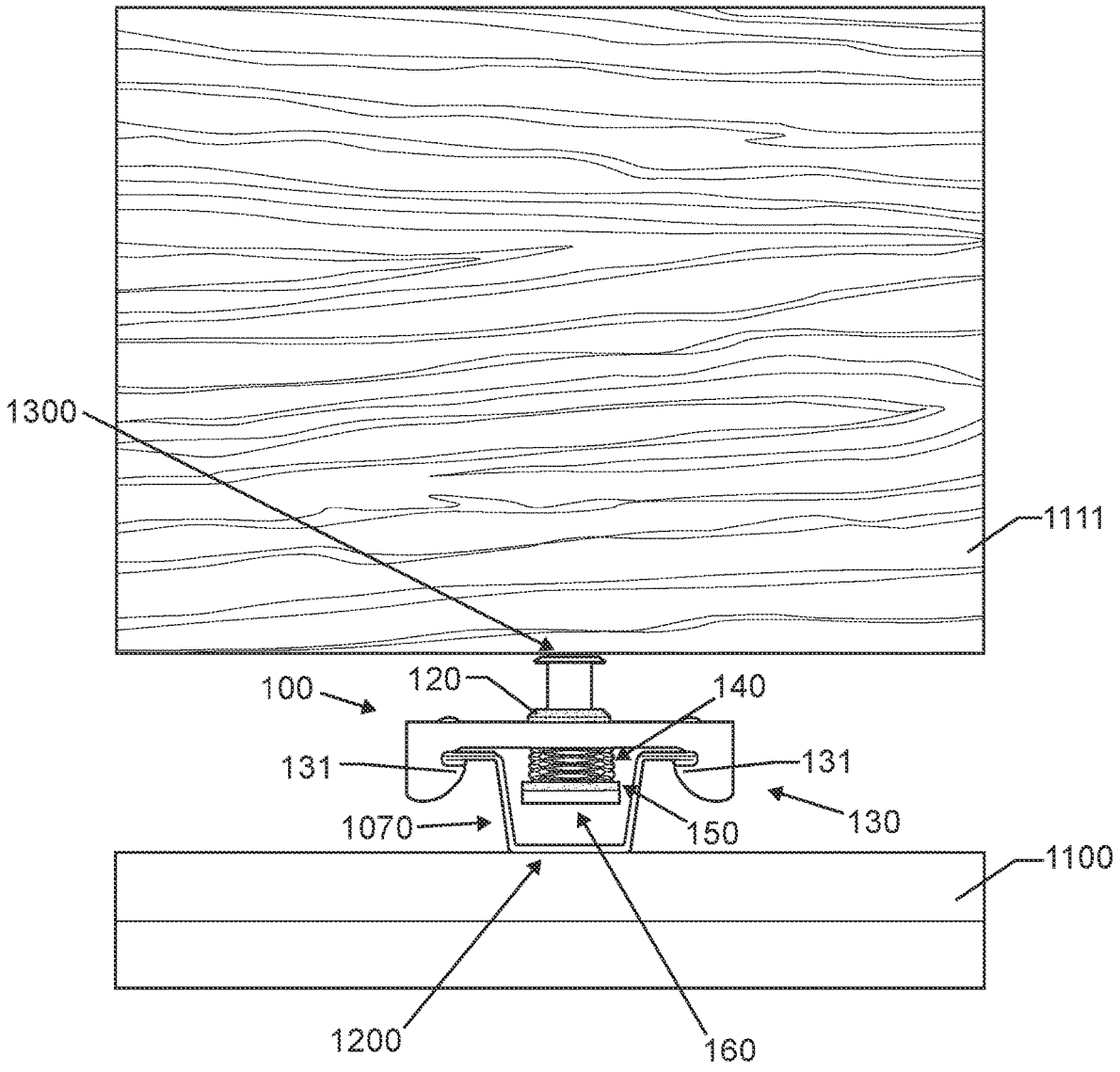
FIG. 9 is an illustration of a side view of one embodiment of the sound isolation assembly connected to a joist and connected to a furring channel, wherein the furring channel is connected to a ceiling panel.

FIG. 9 is an illustration of a side view of one embodiment of the sound isolation assembly connected to a joist and connected to a furring channel, wherein the furring channel is connected to a ceiling panel. The sound isolation assembly 100 may comprise a center ferrule 160, a top grommet isolator 120, a metal claw portion 130 that is configured to retain furring channel 1070 in hooks 131, a bottom grommet isolator 150, and a spring 140. The claw portion 130 and furring channel 1070 may have a friction fit connection. Preferably, the sound isolation assembly 100 may be a complete self-contained noise and vibration isolator product. As shown, the sound isolation assembly 100 may be installed as part of the ceiling of a room. The assembly 100 may be connected to a solid wood joist 1111, preferably via a screw 1300. The furring channel 1070 may be connected to one or more ceiling panels 1100. FIG. 9 shows two stacked ceiling panels, which are connected via a screw, bolt or other type of connector or fastener 1200.

Once the Acoustical Design Load (weight of the ceiling panels 1100) is known, the weight per square foot may be used to determine the spacing of the furring channels 1070 and the assemblies 100. In this case, the Acoustical Design Load is a typical Two (2) layer ⅝" Fire Code C gypsum board 1100 with a weight of two and half (2.5#) pounds per square foot times two (2) layers, which equals five (5) pounds per square foot. The sound isolation assembly 100 may have various types strengths of springs, such as twenty-six (26) pound, thirteen (13) pound, and seven (7) pound Acoustical Design Load versions.

A twenty-six pound spring assembly can support five square foot of ceiling area at the five (5) pound per square foot Acoustical Design Load. A layout with furring channels at sixteen (16") inch center and sound isolation assemblies at forty-eight (48") inch centers. (1.333'×4'=5.33 square foot×5#/square foot=26.65# per sound isolation assembly 100. This five percent additional load is well within the allowable deviation pre-engineered into the Acoustical Design Load. The physical installation of the sound isolation assemblies 100 is preferably very simple. Each sound isolation assembly 100 may have a color-coded spring 140, such as red, white and blue to indicate the strength of the assembly. The ceiling plan layout may preferably indicate the positioning of each sound isolation assembly 100. In one embodiment, the assemblies 100 may be every forty-eight (48") inch center to center. Using a mounting screw 1300 that is inserted through the center ferrule 160 hollow core. The mounting screw 1300 may be driven until the top end of the center ferrule 160 contacts the framing member 1111.

After a line of sound isolation assemblies 100 are installed the furring channels 1070 can be installed by inserting one outward facing flange of the furring channel 1070 into the hooks 131 of one side of the claw portion 130, and then squeeze and push the furring channel opposite flange into the opposite side hooks 131. The furring channel 1070 will snap into place when it is completely engaged with the claw portion 130. The ceiling should now be ready for the gypsum board installation as per the gypsum board manufacturers installation guidelines and/or the Fire Resistive Design requirements. An alternative variable regarding the furring channel spacing may be a fire rated requirement in certain building types having certain specific fire resistive design assemblies which require greater fire endurance classifications. Such as two-hour (2) fire resistive ratings. These may require the spacing of the furring channels 1070 at twelve (12") inch center and the sound isolation assemblies 100 spaced at forty-eight (48") inch or less.

A traditional cylindrical coiled steel compression spring, when attached to a joist or truss type structural framing member requires four (4") inch spring free heights with one (1") full inch of deflection, a steel mounting bracket and a carrier channel at one and one half (1.5") inch vertical height. The net vertical space savings from the bottom of structure to the back of gypsum board with the ceiling spring and rubber sound isolation assembly 100 of the present disclosure is at least one and three eights (1⅜") inch (35 mm). The same installation using a traditional conventional cylindrical coil compression spring requires three and three eights inch (3⅜") (85 mm). The ceiling spring and rubber sound isolation assembly 100, due to its unique configuration, reduces the net overhead space loss by more than half.

The mounting screw 1300 for timber structural installations may be #8 or #7 shank size×Type 17 tip× Course thread× two and three quarter (2¾") inch length× Bugle head×Phillips #2 drive. This screw tested and was ultimately chosen with the #8 or #7 shank to not traumatize the timber structural member and improve the shear value of the larger shaft size. The Type 17 tip is to tear the timber fibers during installation to prevent drag on the shaft causing spiral fracturing of the shaft. The course thread is to maximize the hold and reduce pullout. The three (3") inch length is to ensure a minimum penetration of one and half inch into the structural members. The bugle head is to recess into the ferrule and provide lateral stability to the center ferrule 160. Phillips #2 drive is the most commonly used screw drive in the gypsum board installation industry.

The furring channel 1070 may be one and one half (1½") inch or seven eights (⅞") inch deep× two and three quarter (2¾") inch or less wide× twenty-five (25 ga.) gauge with hemmed edge details. This design has been tested in combination with the claw portion 130 with withdrawal in both shear and pull averaged at eight times the Acoustical Design Load which is greater than five hundred percent (500%) margin of safety.

The mounting screw 1300 may be for timber structural members #7 or #8 shank, type 17 tip, course thread, three (3") inch long, truss head, Phillips #2 drive, rust inhibiting finish.

Alternatively, the mounting screw 1300 may be a slimmer screw to reduce the force needed to install thereby reducing the potential for spiral fracturing of the shank. Alternatively, nails may be used.

Preferably, the mounting screw 1300 should have one and one half inch penetration in the timber framing members 1111 whereas during a fire event the typical 2 by 4 framing member will char from both side resulting in 100% of the timber structural member to be reduced to charcoal by the end of a one hour fire endurance test.

In some embodiments, it might be better to have more depth in the furring channel 1070 upgrading from the common seven eights (⅞") inch depth to the less common one and one half (1½") inch depth by 25 gauge with hemmed edge details. This will allow for a wave spring crest to crest with shim ends composite spring with a full two (2) inch free height and a full one inch of deflection when the Acoustical Design Load is applied.

Figure 10:
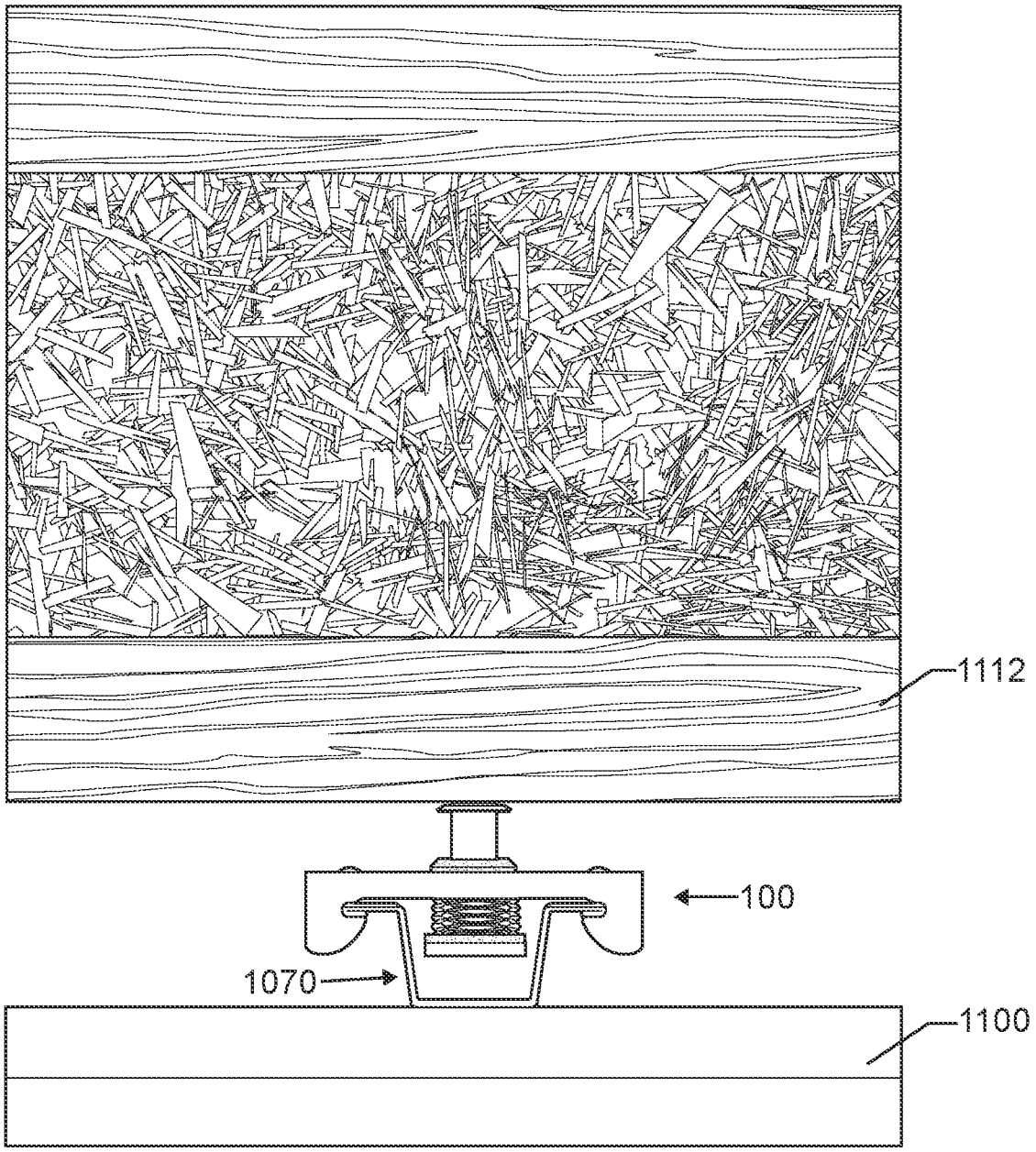
FIG. 10 is an illustration of a side view of one embodiment of the sound isolation assembly connected to a wood I-joist and connected to a furring channel, wherein the furring channel is connected to a ceiling panel.

FIG. 10 is an illustration of a side view of one embodiment of the sound isolation assembly connected to a wood I-joist and connected to a furring channel, wherein the furring channel is connected to a ceiling panel. As shown in FIG. 10, the wood I-joist 1112 may be connected to the assembly 100, which is engaged with a furring channel 1070, which is connected to ceiling panels 1100. FIGS. 10-15 show that the assembly 100 may be used in conjunction with many types of ceilings, ceiling mounts, floor ceilings, structural types, and wall types.

Figure 11:
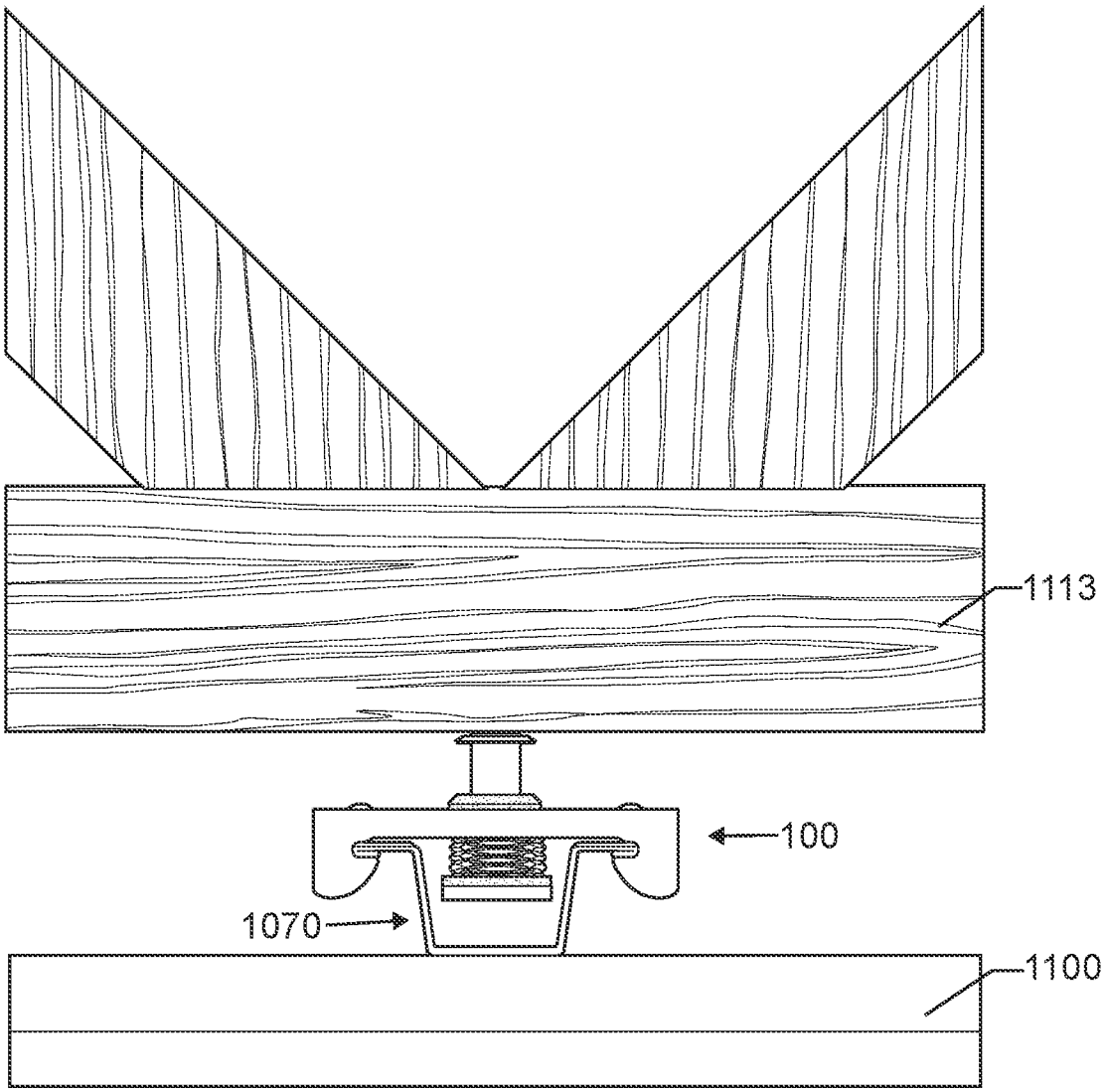
FIG. 11 is an illustration of a side view of one embodiment of the sound isolation assembly connected to a truss and connected to a furring channel, wherein the furring channel is connected to a ceiling panel.

FIG. 11 is an illustration of a side view of one embodiment of the sound isolation assembly connected to a truss and connected to a furring channel, wherein the furring channel is connected to a ceiling panel. As shown in FIG. 11, the wood open web truss 1113 may be connected to the assembly 100, which is engaged with a furring channel 1070, which is connected to ceiling panels 1100.

Figure 12:
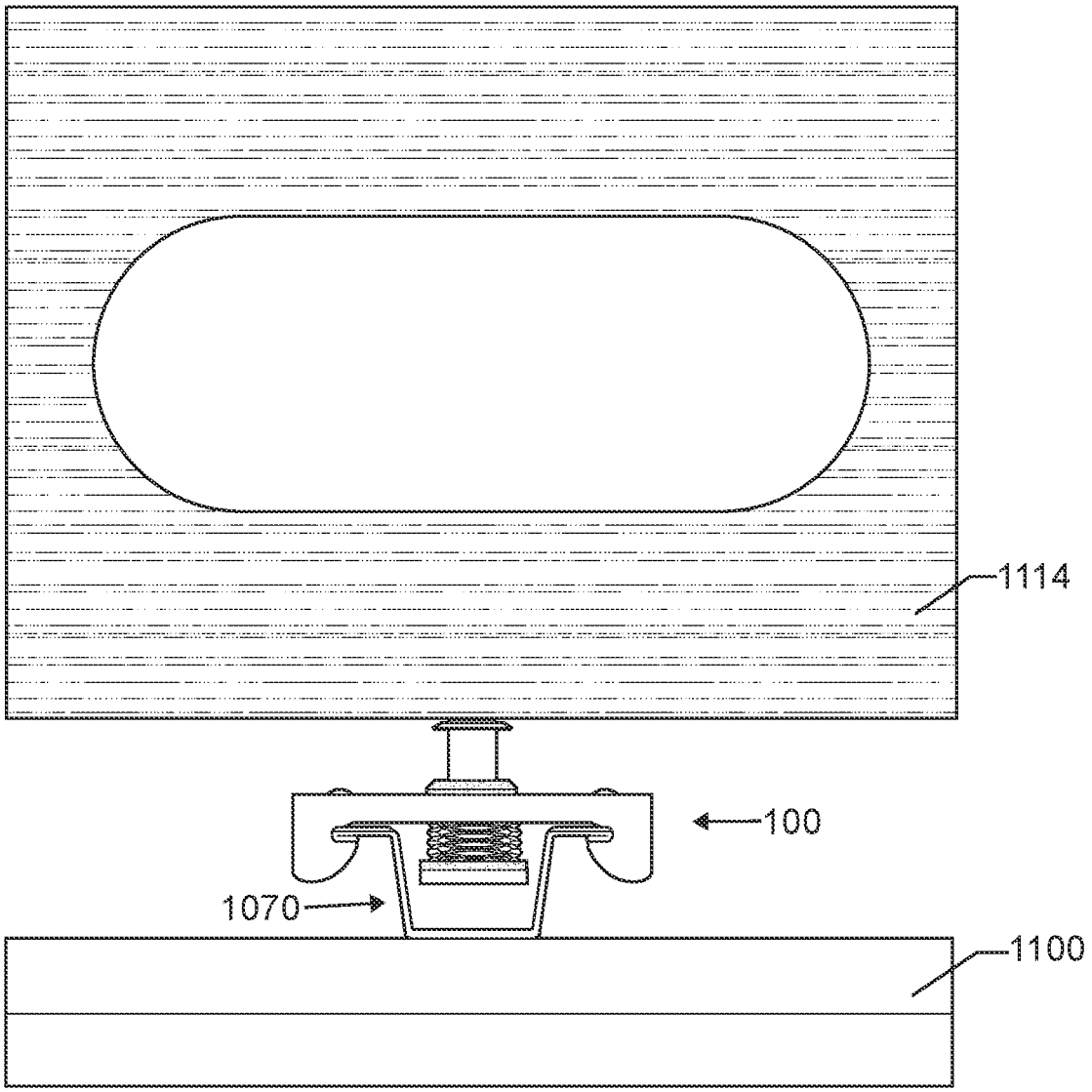
FIG. 12 is an illustration of a side view of one embodiment of the sound isolation assembly connected to a steel C section and connected to a furring channel, wherein the furring channel is connected to a ceiling panel.

FIG. 12 is an illustration of a side view of one embodiment of the sound isolation assembly connected to a steel C section and connected to a furring channel, wherein the furring channel is connected to a ceiling panel. As shown in FIG. 12, the steel C-section 1114 may be connected to the assembly 100, which is engaged with a furring channel 1070, which is connected to ceiling panels 1100.

Figure 13:
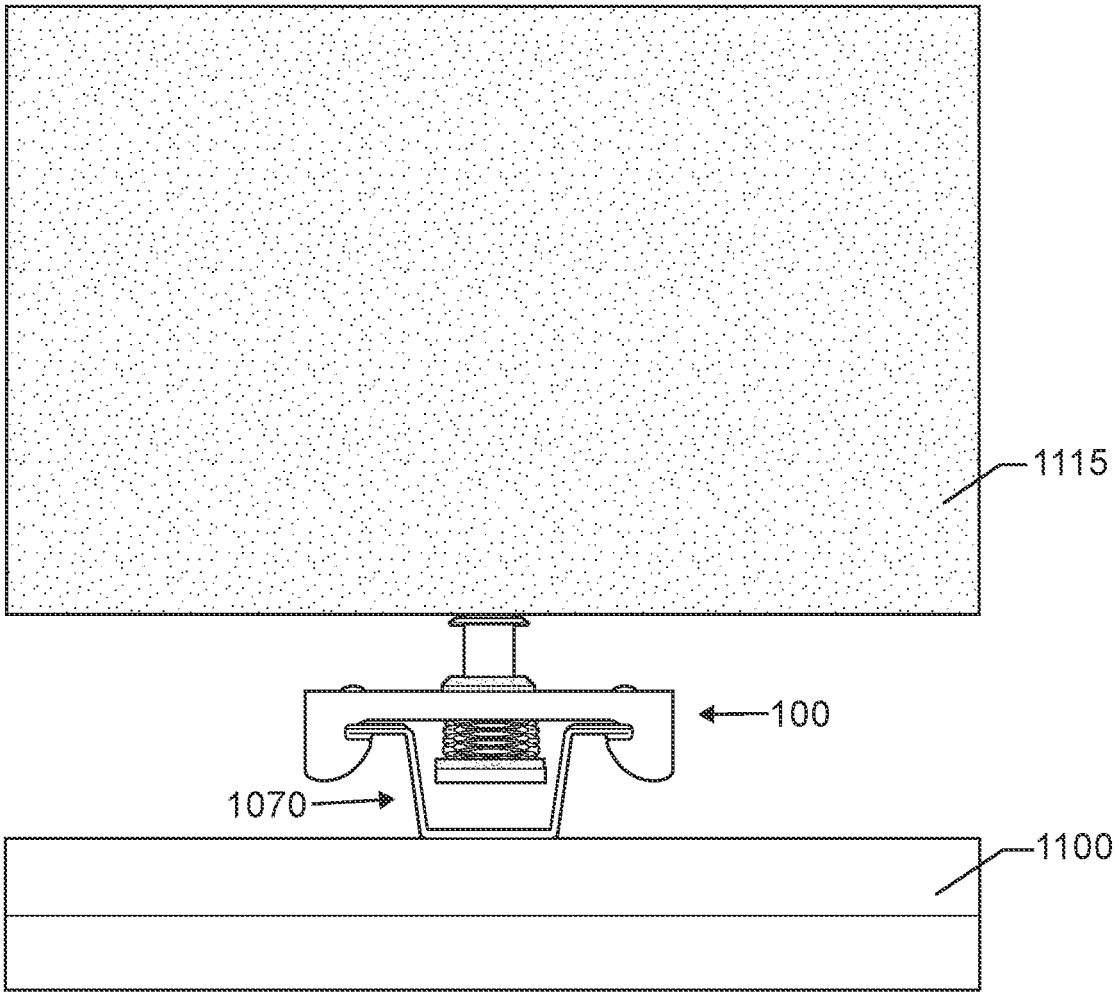
FIG. 13 is an illustration of a side view of one embodiment of the sound isolation assembly connected to a concrete slab and connected to a furring channel, wherein the furring channel is connected to a ceiling panel.

FIG. 13 is an illustration of a side view of one embodiment of the sound isolation assembly connected to a concrete slab and connected to a furring channel, wherein the furring channel is connected to a ceiling panel. As shown in FIG. 13, the concrete slab 1115 may be connected to the assembly 100, which is engaged with a furring channel 1070, which is connected to ceiling panels 1100. A traditional cylindrical coiled steel compression spring when attached to the bottom of a concrete slab type structural framing member requires ten inch (250 mm) vertical height. The net vertical space from bottom of structure to back of gypsum board with the sound isolation assembly 100 is two and seven eights (2⅞") inch (72 mm). The net difference (Delta) in vertical space is seven and one eighth (7⅛") inch (178 mm). In some embodiments, the sound isolation assembly 100 total cost of materials and labor installed should be less than half the cost of traditional cylindrical coil compression steel springs.

Figure 14:
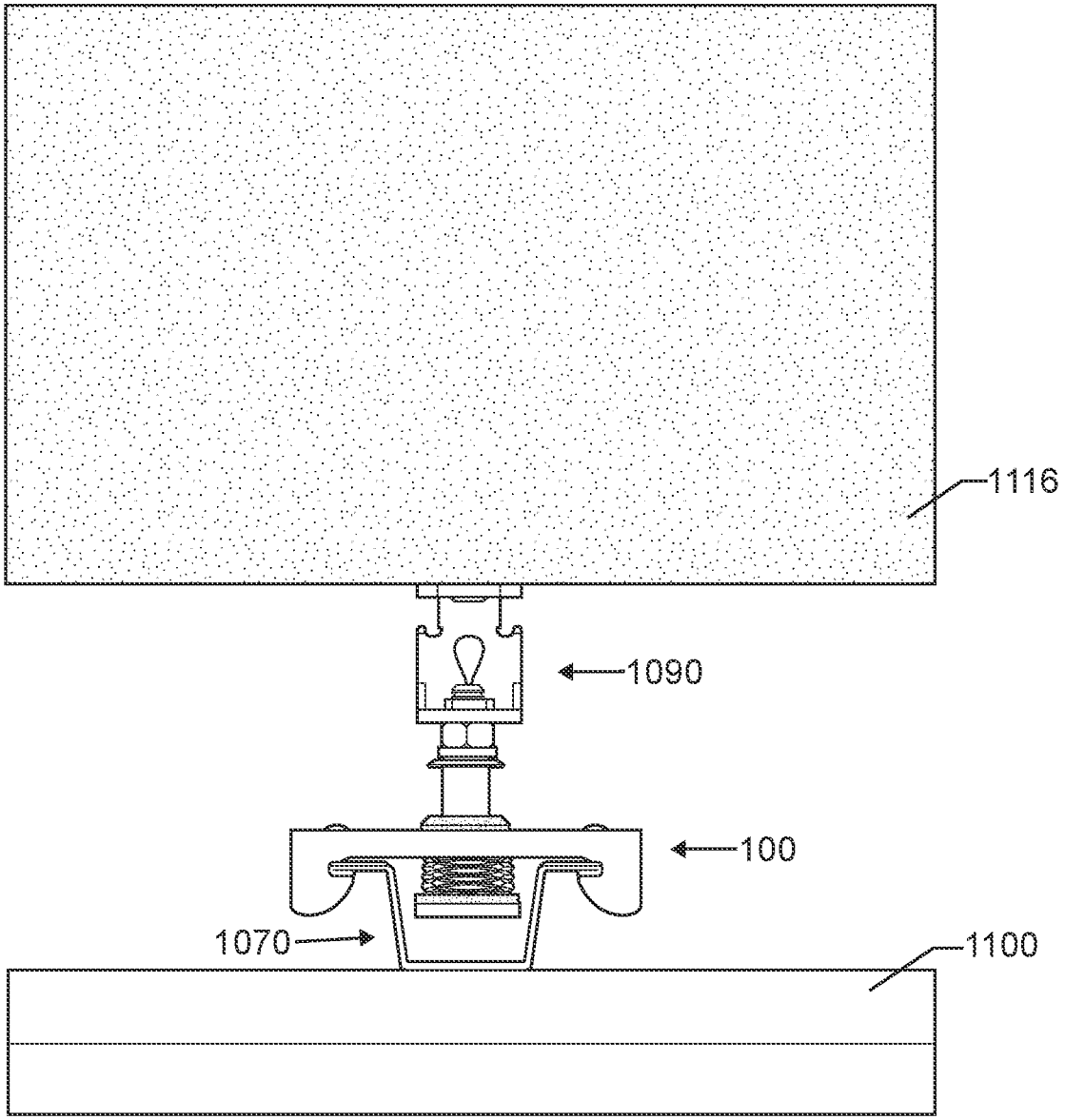
FIG. 14 is an illustration of a side view of one embodiment of the sound isolation assembly connected to multi-clip, which is connected to a concrete slab, and connected to a furring channel, wherein the furring channel is connected to a ceiling panel.

FIG. 14 is an illustration of a side view of one embodiment of the sound isolation assembly connected to multi-clip, which is connected to a concrete slab, and connected to a furring channel, wherein the furring channel is connected to a ceiling panel. As shown in FIG. 14, the concrete slab 1116 may be connected to a multi-clip 1090, which is connected to the assembly 100, which is engaged with a furring channel 1070, which is connected to ceiling panels 1100.

FIG. 14 shows an alternative mounting system to bolt or rivet the sound isolation assembly 100 to a multi-clip 1090. The multi-clip 1090 may be a "L" bracket with a preset deflection point which allows the top half of the long vertical leg to be bent to make a "C" shape attachment clip. The multi-clip 1090 may be connected to the sound isolation assembly 100 using a ¼-20 fastener fitted through the center of the ferrule 160 with a ¼-20 jamb nut to lock the multi-clip 1090 to the center ferrule 160. The multi-clip 1090 is then secured to the structural supporting member on the bottom or the side of the structural members with a fastener, usually a screw or tested nails.

The sound isolation assembly 100 can also be side mounted on the joist or truss type structural member using a multi-clip 1090 connector and reduce the net space from bottom of structural framing members to back of gypsum board to as little as one and one eighth inch (1-⅛") (28 mm).

When the sound isolation assembly 100 is used with the alternative mounting multi-clip 1090, it may be secured with ¼-20 flat head machine screw. The sound isolation assembly 100 may be two and three quarter (2¾") (70 mm) inch from bottom of the structure to back of gypsum board. In the same installation the traditional cylindrical coil compression spring isolator uses ten (10") (250 mm) inch of head room. The use of the multi-clip 1090 overhead height adjustable mount adaptor allows the sound isolation assembly 100 to connect to a concrete or steel metal deck and concrete overhead using a gas, powder, or spring power driven fastener such as a concrete nail or concrete screw installed into the overhead.

In other embodiments, the use of the multi-clip overhead adaptor may increase the distance between the structural members and the back of gypsum board to break the air stiffness coupling common in small air cavities.

Structural Alternatives: The sound isolation assembly 100 can be fitted with a ¼-20 tap bolt or machine screw and jamb nut for installation where internally threaded drop-in split anchors can be used, such as concrete slabs floor-ceilings. This application is called "Direct Mount". As a cost-effective alternative installation, the sound isolation assembly 100 can be fitted with a ¼-20 tap bolt or machine screw, a ¼-20 jamb nut, and a multi-clip 1090 (overhead adaptor) to allow installation on the concrete ceiling using powered concrete nail type fasteners. Another alternative for a Cross Laminated Timber (CLT) ceiling is using a one and one half (1½") inch course thread screw.

Figure 15:
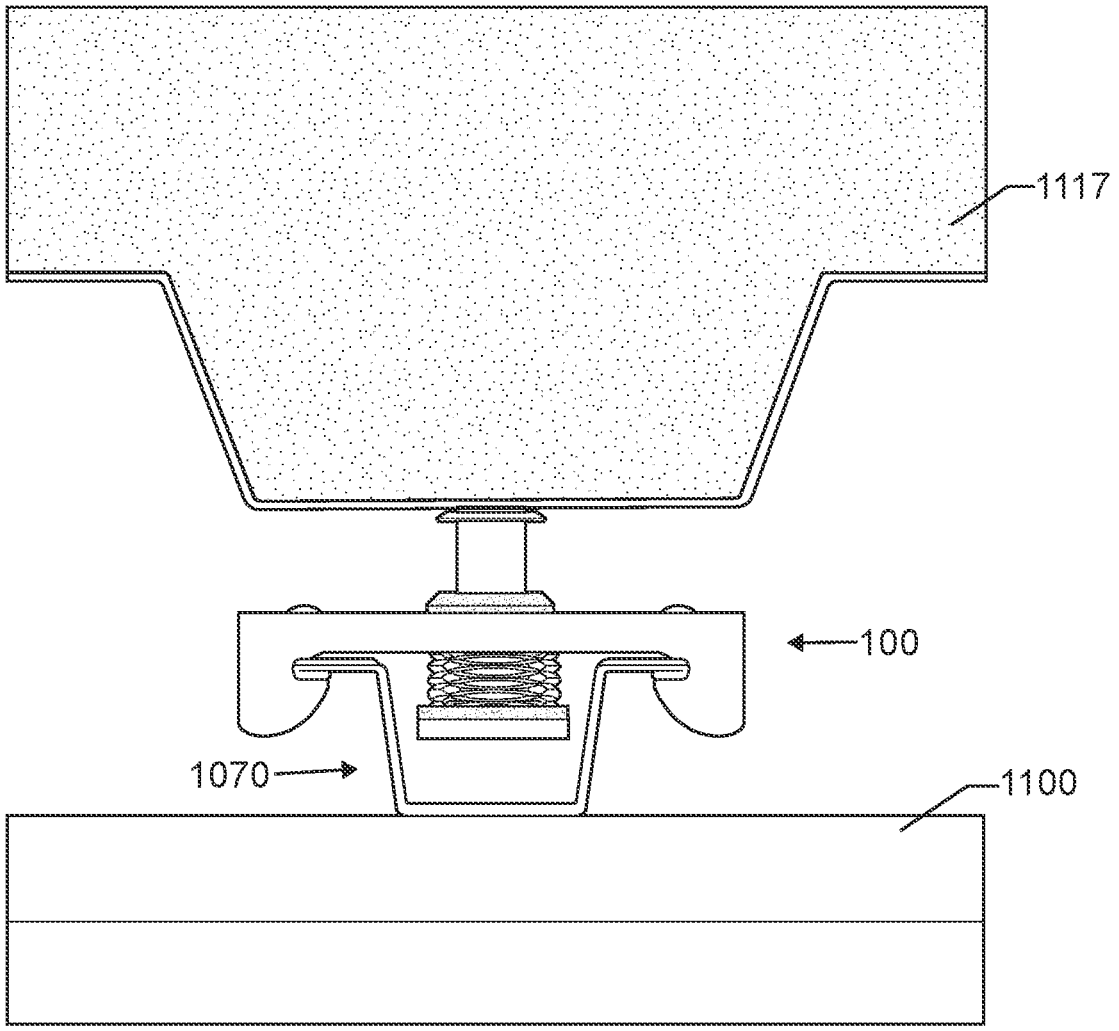
FIG. 15 is an illustration of a side view of one embodiment of the sound isolation assembly connected to a steel pan deck system and connected to a furring channel, wherein the furring channel is connected to a ceiling panel.

FIG. 15 is an illustration of a side view of one embodiment of the sound isolation assembly connected to a steel pan deck system and connected to a furring channel, wherein the furring channel is connected to a ceiling panel. As shown in FIG. 15, the steel pan deck 1117 may be connected to the assembly 100, which is engaged with a furring channel 1070, which is connected to ceiling panels 1100.

FIG. 16 is a testing table showing the acoustic tests results of a best in class furring channel without the sound isolation assembly, showing Sound Transmission Class (STC) (decibels at selected frequencies), Impact Isolation Class (IIC) using ASTM E-492 (normalized decibels at selected frequencies), High Impact Isolation Class (HIIC) using ASTM E-3222 (normalized decibels at selected frequencies), and Low Impact Isolation Class (LIIC) using ASTM E-3222 (normalized decibels at selected frequencies). FIG. 16 shows the control data.

FIG. 17 is a testing table showing the acoustic tests results of the furring channel used in connection with a sound isolation assembly of the present disclosure, showing Sound Transmission Class (STC) (decibels at selected frequencies), Impact Isolation Class (IIC) using ASTM E-492 (normalized decibels at selected frequencies), High Impact Isolation Class (HIIC) using ASTM E-3222 (normalized decibels at selected frequencies), and Low Impact Isolation Class (LIIC) using ASTM E-3222 (normalized decibels at selected frequencies). FIG. 17 shows the data associated with use of the sound isolation assembly of the present disclosure.

Figure 18:
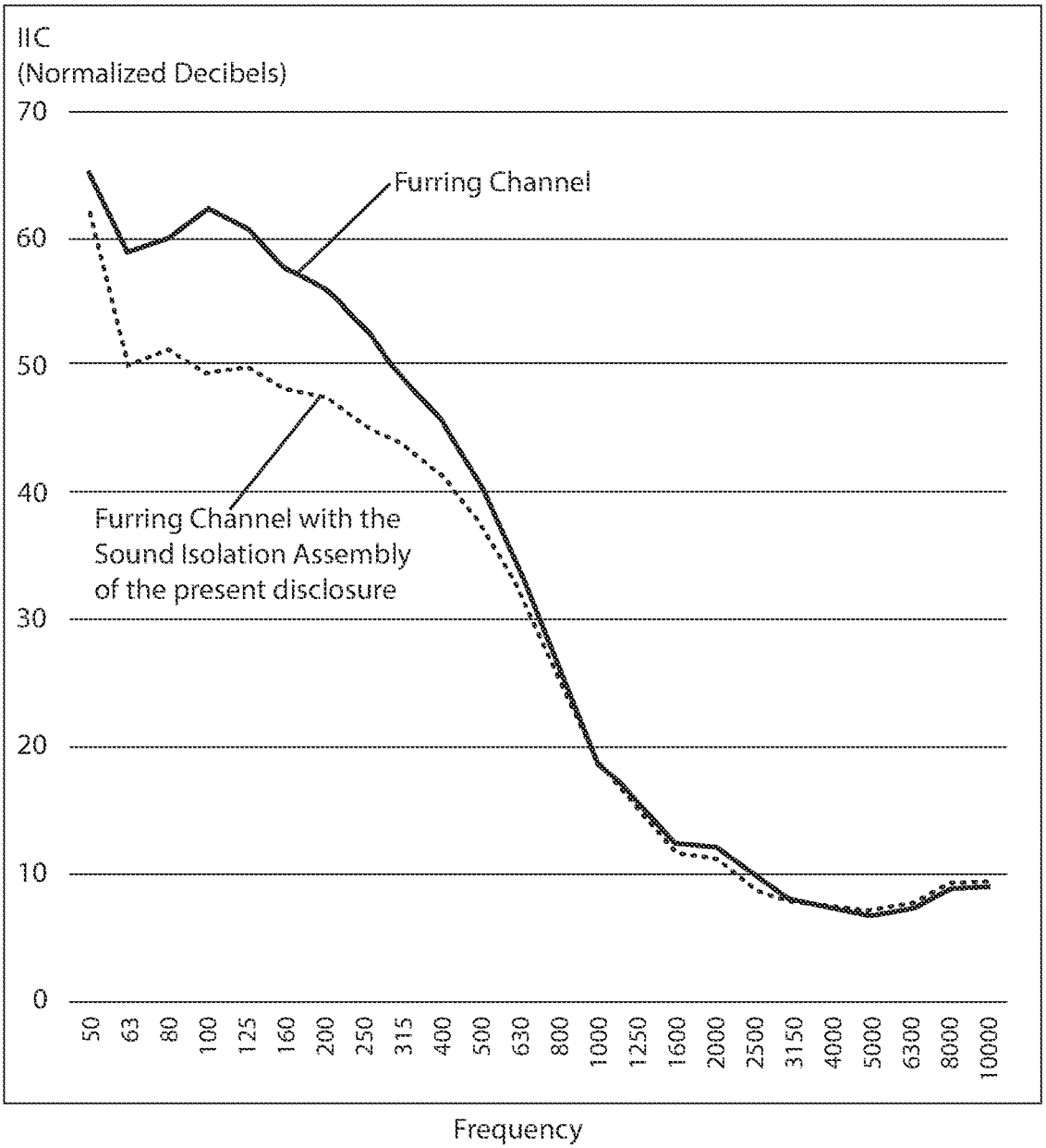
FIG. 18 is a comparison graph showing the acoustic tests results for Impact Isolation Class (IIC) and shows the acoustical properties with and without the sound isolation assembly of the present disclosure.

FIG. 18 is a comparison graph showing the acoustic tests results for Impact Isolation Class (IIC) and shows the acoustical properties with and without the sound isolation assembly of the present disclosure. FIG. 18 shows the dramatic increase in IIC noise control, specifically, at the relatively lower frequencies, where noise is most bothersome.

Figure 19:
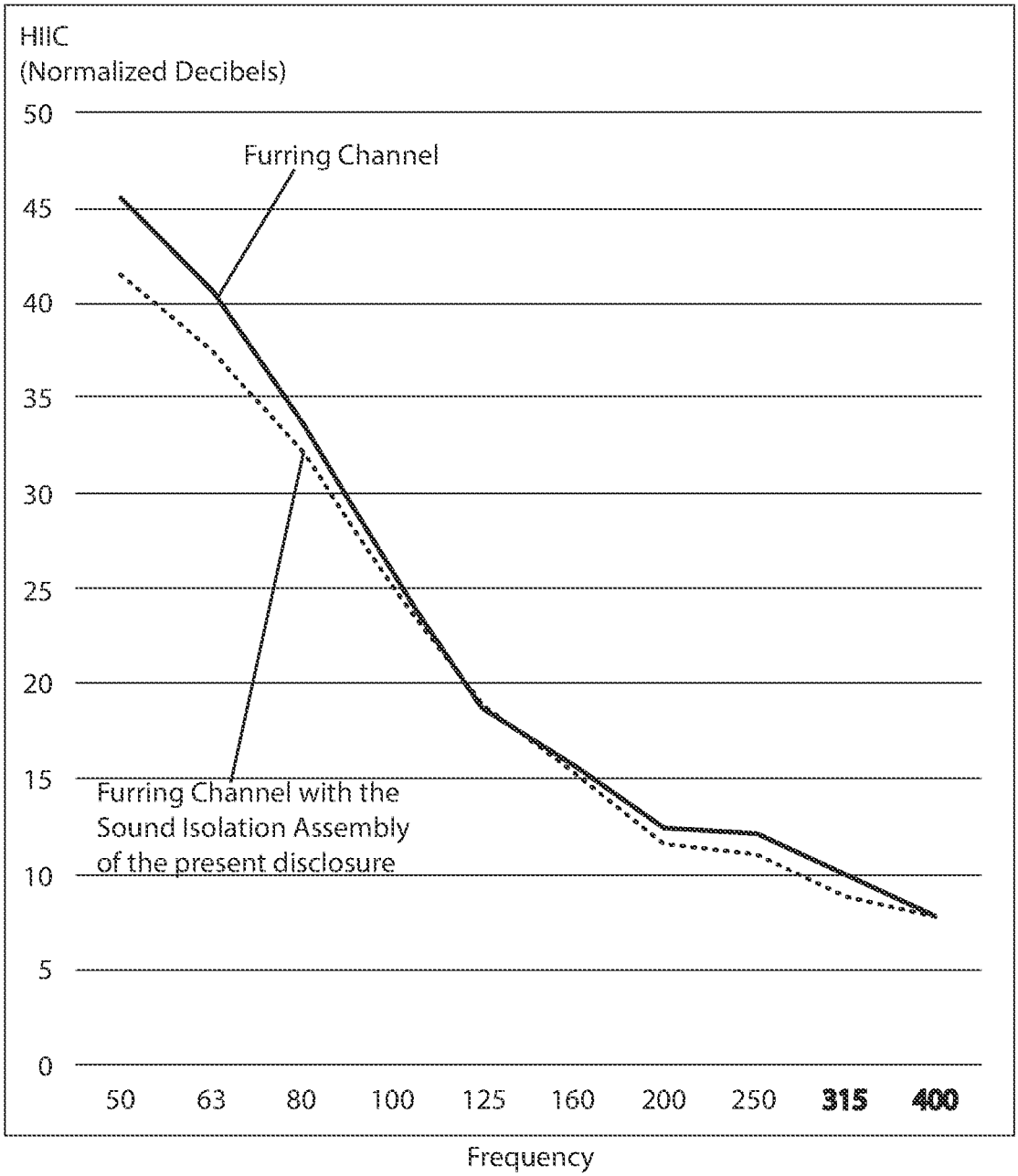
FIG. 19 is a comparison graph showing the acoustic tests results for High Impact Isolation Class (HIIC) and shows the acoustical properties with and without the sound isolation assembly of the present disclosure.

FIG. 19 is a comparison graph showing the acoustic tests results for High Impact Isolation Class (HIIC) and shows the acoustical properties with and without the sound isolation assembly of the present disclosure. FIG. 19 shows the dramatic increase in the HIIC noise control when the system uses the sound isolation assembly of the present disclosure. Specifically, noise control is improved at the higher frequency ranges.

Figure 20:
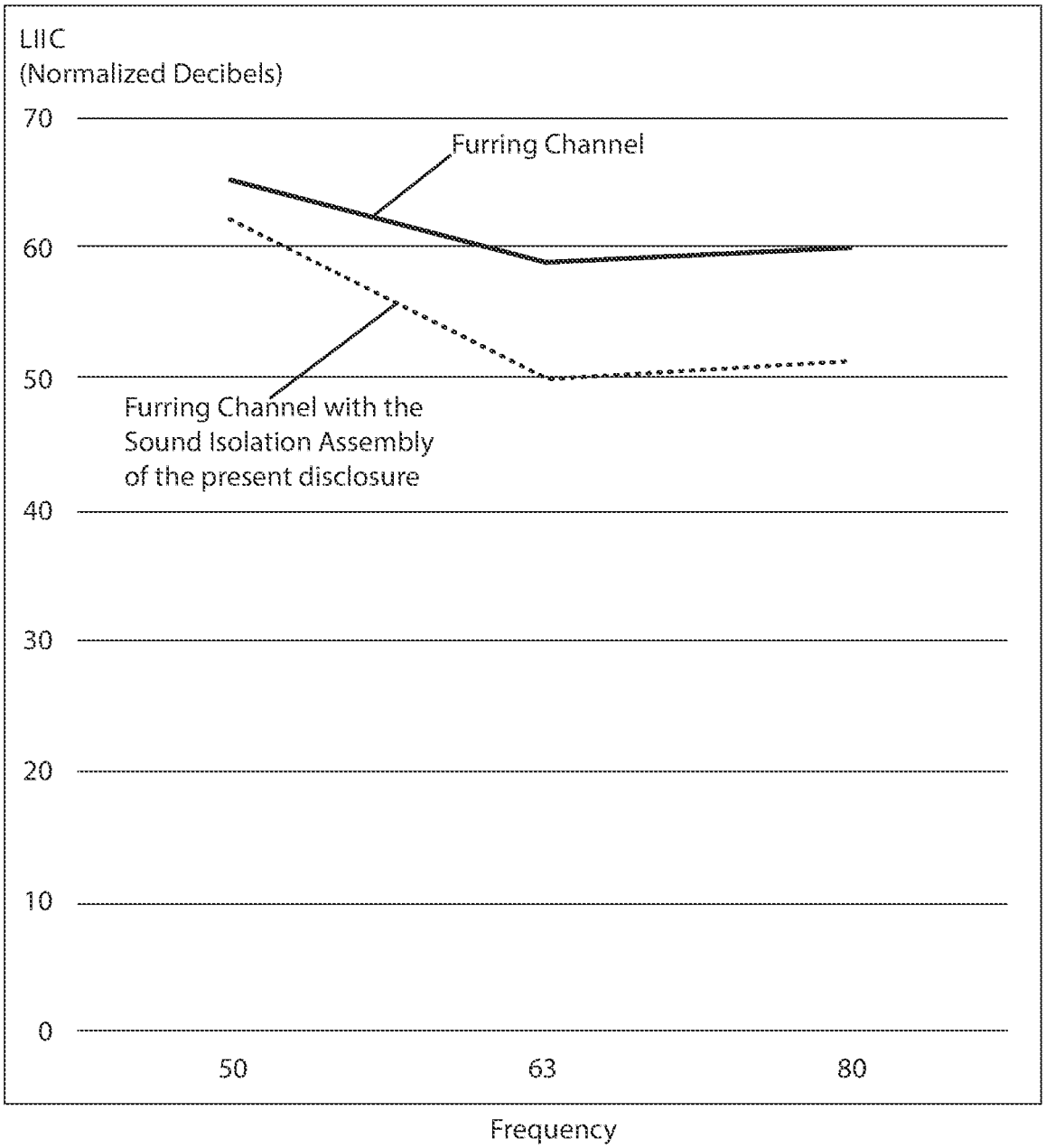
FIG. 20 is a comparison graph showing the acoustic tests results for Low Impact Isolation Class (LIIC) and shows the acoustical properties with and without the sound isolation assembly of the present disclosure.

FIG. 20 is a comparison graph showing the acoustic tests results for Low Impact Isolation Class (LIIC) and shows the acoustical properties with and without the sound isolation assembly of the present disclosure. FIG. 20 shows the substantial increase in the LIIC noise control when the system uses the sound isolation assembly of the present disclosure. Specifically, noise control is improved at lower frequencies, where impact noise is most critical.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description. These embodiments are capable of modifications in various obvious aspects, all without departing from the spirit and scope of protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. A sound isolation assembly comprising:

a center ferrule;

a top grommet isolator;

a bottom grommet isolator;

a spring; and a furring channel engagement portion;

wherein said center ferrule comprises a shaft and a center ferrule base;

wherein said bottom grommet isolator comprises a bottom grommet base;

wherein said top grommet isolator comprises a top grommet base;

wherein said furring channel engagement portion comprises a hole and is configured to engage with a furring channel;

wherein said top grommet base is configured to engage with both a top portion of said spring and an underside of said furring channel engagement portion, such that said spring is substantially prevented from contacting said furring channel engagement portion;

wherein said bottom grommet base is configured to engage with both said center ferrule base and a bottom portion of said spring, such that said spring is substantially prevented from contacting said center ferrule;

wherein said center ferrule base and said spring each have a diameter that is greater than the diameter of said hole of said furring channel engagement portion; and wherein said center ferrule is configured to be connected to be attached to a structure.

2. The sound isolation assembly of claim 1, further comprising:

a snap retainer clip;

wherein said center ferrule further comprises a snap retainer clip groove at a top portion of said shaft of said center ferrule; and wherein said snap retainer clip is configured to matingly engage with said snap retainer clip groove, such that, when said sound isolation assembly is assembled and said snap retainer clip is snapped into said snap retainer clip groove, said top grommet isolator, said furring channel engagement portion, said spring, and said bottom grommet isolator are substantially held below said snap retainer clip.

3. The sound isolation assembly of claim 1, wherein said spring is a steel spring.

4. The sound isolation assembly of claim 1, wherein said spring is a multi-wave crest to crest compact steel spring with shim ends.

5. The sound isolation assembly of claim 1, wherein said spring is selected from the group of springs consisting of: compression; multi-wave; conical; tapered; cylindrical; barrel;

double barrel; hourglass; convex; concave; straight coil; and volute.

6. The sound isolation assembly of claim 1, further comprising a center brushing that is configured to be between said shaft and said spring, and that is configured to keep said spring from becoming misaligned.

7. The sound isolation assembly of claim 1, wherein said top grommet isolator further comprises a centering cone that is configured to keep said spring from becoming misaligned.

8. The sound isolation assembly of claim 1, wherein said bottom grommet isolator further comprises a centering cone that is configured to keep said spring from becoming misaligned.

9. The sound isolation assembly of claim 1, wherein said top grommet isolator further comprises a top centering cone that is configured to keep said spring from becoming misaligned; and wherein said bottom grommet isolator further comprises a centering cone that is configured to keep said spring from becoming misaligned.

10. The sound isolation assembly of claim 1, wherein said structure is a structure selected from the group of structures consisting of: a joist; a wood I-joist; a truss; a steel C section; a concrete slab; a steel pan deck; and a multi-clip.

11. The sound isolation assembly of claim 1, wherein when said sound isolation assembly is connected to said structure, and when said furring channel engagement portion is connected to said furring channel, and when said furring channel is connected to a ceiling panel, noise passing through said ceiling panel is substantially dampened relative to a control system that does not use said sound isolation assembly.

12. The sound isolation assembly of claim 2, wherein said snap retainer clip is substantially ring shaped;

wherein said top grommet isolator is substantially ring shaped; and wherein said bottom grommet isolator is substantially ring shaped.

13. A sound isolation assembly comprising:

a center ferrule;

a top grommet isolator;

a bottom grommet isolator;

a snap retainer clip;

a spring; and a furring channel engagement portion;

wherein said center ferrule comprises a shaft and a center ferrule base;

wherein said bottom grommet isolator comprises a bottom grommet base;

wherein said top grommet isolator comprises a top grommet base;

wherein said furring channel engagement portion comprises a hole and is configured to engage with a furring channel;

wherein said top grommet base is configured to engage with both a top portion of said spring and an underside of said furring channel engagement portion, such that said spring is substantially prevented from contacting said furring channel engagement portion;

wherein said bottom grommet base is configured to engage with both said center ferrule base and a bottom portion of said spring, such that said spring is substantially prevented from contacting said center ferrule;

wherein said center ferrule base and said spring each have a diameter that is greater than the diameter of said hole of said furring channel engagement portion;

wherein said center ferrule is configured to be attached to a structure;

wherein said center ferrule further comprises a snap retainer clip groove at a top portion of said shaft of said center ferrule;

wherein said snap retainer clip is configured to matingly engage with said snap retainer clip groove, such that, when said sound isolation assembly is assembled and said snap retainer clip is snapped into said snap retainer clip groove, said top grommet isolator, said furring channel engagement portion, said spring, and said bottom grommet isolator are substantially held below said snap retainer clip; and wherein when said sound isolation assembly is connected to said structure, and when said furring channel engagement portion is connected to said furring channel, and when said furring channel is connected to a ceiling panel, noise passing through said ceiling panel is substantially dampened relative to a control system that does not use said sound isolation assembly.

14. The sound isolation assembly of claim 13, wherein said spring is a multi-wave crest to crest compact steel spring with shim ends.

15. The sound isolation assembly of claim 13, wherein said spring is steel and is selected from the group of springs consisting of: compression; multi-wave; conical; tapered; cylindrical; barrel; double barrel; hourglass; convex; concave; straight coil; and volute.

16. The sound isolation assembly of claim 13, further comprising a center brushing that is configured to be between said shaft and said spring, and that is configured to keep said spring from becoming misaligned.

17. The sound isolation assembly of claim 13, wherein said top grommet isolator further comprises a centering cone that is configured to keep said spring from becoming misaligned.

18. The sound isolation assembly of claim 13, wherein said bottom grommet isolator further comprises a centering cone that is configured to keep said spring from becoming misaligned.

19. The sound isolation assembly of claim 13, wherein said snap retainer clip is substantially ring shaped;

wherein said top grommet isolator is substantially ring shaped; and wherein said bottom grommet isolator is substantially ring shaped.

20. A sound isolation assembly comprising:

a center ferrule;

a rubber top grommet isolator;

a rubber bottom grommet isolator;

a snap retainer clip;

a steel spring; and a furring channel engagement portion;

wherein said center ferrule comprises a shaft and a center ferrule base;

wherein said bottom grommet isolator comprises a bottom grommet base;

wherein said top grommet isolator comprises a top grommet base;

wherein said furring channel engagement portion comprises a hole and is configured to engage with a furring channel;

wherein said top grommet base is configured to engage with both a top portion of said spring and an underside of said furring channel engagement portion, such that said spring is substantially prevented from contacting said furring channel engagement portion;

wherein said bottom grommet base is configured to engage with both said center ferrule base and a bottom portion of said spring, such that said spring is substantially prevented from contacting said center ferrule;

wherein said center ferrule base and said spring each have a diameter that is greater than the diameter of said hole of said furring channel engagement portion;

wherein said center ferrule is configured to be connected to be attached to a structure;

wherein said center ferrule further comprises a snap retainer clip groove at a top portion of said shaft of said center ferrule;

wherein said snap retainer clip is configured to matingly engage with said snap retainer clip groove, such that, when said sound isolation assembly is assembled and said snap retainer clip is snapped into said snap retainer clip groove, said top grommet isolator, said furring channel engagement portion, said spring, and said bottom grommet isolator are substantially held below said snap retainer clip;

wherein when said sound isolation assembly is connected to said structure, and when said furring channel engagement portion is connected to said furring channel, and when said furring channel is connected to a ceiling panel, noise passing through said ceiling panel is substantially dampened relative to a control system that does not use said sound isolation assembly;

wherein said snap retainer clip is substantially ring shaped;

wherein said top grommet isolator is substantially ring shaped; and wherein said bottom grommet isolator is substantially ring shaped.

* * * * *